US008722303B2

(12) United States Patent
Horie et al.

(10) Patent No.: US 8,722,303 B2
(45) Date of Patent: May 13, 2014

(54) IMAGE FORMING METHOD

(75) Inventors: Juun Horie, Tokyo (JP); Takeshi Yamamoto, Yokohama (JP); Yoshinobu Baba, Yokohama (JP); Koh Ishigami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/594,118

(22) Filed: Aug. 24, 2012

(65) Prior Publication Data

US 2013/0052580 A1 Feb. 28, 2013

(30) Foreign Application Priority Data

Aug. 31, 2011 (JP) ..... 2011-188115

(51) Int. Cl.
*G03G 9/08* (2006.01)

(52) U.S. Cl.
USPC ..... 430/123.58; 430/111.32; 430/111.33

(58) Field of Classification Search
USPC ..... 430/123.58, 111.32, 111.33
See application file for complete search history.

(56) References Cited

U.S. PATENT DOCUMENTS

| | | | |
|---|---|---|---|
| 7,476,482 | B2 | 1/2009 | Iinuma et al. |
| 7,858,283 | B2 | 12/2010 | Ishigami et al. |
| 2006/0269862 | A1 | 11/2006 | Kobayashi et al. |
| 2010/0159382 | A1 | 6/2010 | Horie et al. |

FOREIGN PATENT DOCUMENTS

| | | | |
|---|---|---|---|
| EP | 1729180 | A1 | 12/2006 |
| EP | 2312397 | A1 | 4/2011 |
| JP | 60-19157 | A | 1/1985 |
| JP | 10-83120 | A | 3/1998 |
| JP | 2007-102052 | A | 4/2007 |
| JP | 2007-218955 | A | 8/2007 |
| JP | 2010-170106 | A | 8/2010 |
| WO | 2005/048276 | A2 | 5/2005 |

OTHER PUBLICATIONS

Hiraga et al., "Ferrite", pp. 16-19, 38 and 39, Maruzen, Co., Ltd., 1988.

Barsoukov et al., "Impedance Spectroscopy: Theory, Experiment, and Applications", Mar. 17, 2005, pp. 28-35 and 90-95, Wiley-Interscience.

Communication with a European Search Report issued Jan. 3, 2013, in European Application No. 12181950.2-1217.

*Primary Examiner* — Mark A Chapman

(74) *Attorney, Agent, or Firm* — Fitzpatrick, Cella, Harper & Scinto

(57) ABSTRACT

An image forming method using a two component developing system is provided in which a print speed is not less than 300 mm/s, a peak-to-peak voltage of an AC component in a developing bias is not more than 1.3 kV, a sufficient image density can be ensured, and a recorded image having a small amount of magnetic carrier remaining on the image and having high image quality can be obtained. A magnetic carrier that forms a two component developer contains a magnetic core and a resin. The magnetic core is a ferrite containing Sr and Ca inside thereof at the same time, having a small crystal grain diameter, a high density crystal-grain boundary structure, and an extremely large capacitance of the grain boundary. Use of the ferrite can provide the above method.

5 Claims, 7 Drawing Sheets

CROSS SECTION OF MAGNETIC CARRIER

CROSS SECTION OF MAGNETIC CARRIER

CAPTURED IMAGE (a) OF BACKSCATTERED ELECTRON IMAGE OF CROSS SECTION OF MAGNETIC CARRIER

BLACK-AND-WHITE CONVERTED IMAGE (b) OF CAPTURED IMAGE

CAPTURED IMAGE (a) OF BACKSCATTERED ELECTRON IMAGE OF CROSS SECTION OF MAGNETIC CARRIER

EDGE-ENHANCED IMAGE (b) OF CAPTURED IMAGE

FLOWCHART FOR MEASUREMENT OF COMPLEX IMPEDANCE

FLOWCHART FOR FITTING OF EQUIVALENT CIRCUIT

IMAGE FORMING METHOD

BACKGROUND OF THE INVENTION

1. Field of the Invention

The present invention relates to an image forming method using a two component developing system in which a two component developer having a toner and a carrier is carried on a developer carrying member, and a developing bias including a DC voltage and an AC voltage superimposed on the DC voltage is applied to the developer carrying member to develop the toner on an electrostatic image formed on an image bearing member.

2. Description of the Related Art

In the related art, in image forming apparatuses such as copying machines and printers using electrophotography, an image bearing member having a photosensitive layer as a surface layer is subjected to charging and exposure to form an electrostatic image, the photosensitive layer being formed with a photoconductor such as an OPC (organic photo conductive) photosensitive member and an amorphous silicon photosensitive member. Thereafter, by a development field caused by an action of the developing bias applied to the developer carrying member, in a development region in which the image bearing member faces a developer carrying member, the electrostatic image is developed by a toner to form a toner image on the photosensitive member. Further, the toner image on the photosensitive member is transferred on a transfer material directly or via an intermediate transfer member. Subsequently, the toner image is fixed on a transfer material such as paper to obtain a recorded image. Particularly, in the image forming method using the two component developing system, when the two component developer including at least a toner and a magnetic carrier is conveyed to the development region by the developer carrying member, the toner is separated from a magnetic carrier particle by the development field generated by the developing bias, and as a result, the electrostatic image formed on the photosensitive member is electrostatically developed.

Recently, higher print speed and higher quality of an output image have been demanded for the copying machines and printers, and at the same time, reduction in environmental load in the print process has been strongly demanded. For example, as a technique for reducing power consumption during printing, a technique has been developed in which the toner is fixed on the transfer material by reducing the melting point of the toner to lower the fixing temperature. If the melting point of the toner is reduced, however, the temperature is raised by stirring the developer or the viscosity of the toner is increased by change in an environment or the like, leading to a non-electrostatic adhesive force between the magnetic carrier and the toner. For this reason, developability is undesirably reduced over time in printing for a long period of time.

In the related art, in the image forming method using the two component developing system, an alternating bias including a DC voltage and an AC voltage superimposed on the DC voltage is used as the developing bias. Thereby, the amount of the toner to be developed can be increased, and a recorded image having high density and high quality can be output.

Unfortunately, at a higher process speed of not less than 300 mm/s, it is found out that the time during which the developer passes through the development region is shortened, therefore reducing the time during which the toner is exposed to the development field, leading to difficulties to keep a sufficient amount of the toner to be developed. It is also found out that if the peak-to-peak voltage of the AC component in the developing bias is increased in order to ensure a sufficient amount of the toner to be developed, and the developer proposed in the related art is used, a peak-to-peak voltage of not less than 1.5 kV is needed to output a recorded image having a desired density.

Unfortunately, it is found out that if the peak-to-peak voltage of the AC component in the developing bias is more than 1.3 kV, the magnetic carrier adheres onto the photosensitive member to cause a phenomenon in which the remains of the magnetic carrier on the toner image manifest themselves as a blank. The reason is thought as follows. Increase in the process speed leads to a higher conveying speed of the developer in the development region, and a centrifugal force of the magnetic carrier separating from the developer carrying member is also increased. Moreover, increase in the peak-to-peak voltage of the developing bias leads to increase in an amount of charges having the same polarity as that of the toner to be injected into the magnetic carrier. As a result, the magnetic carrier easily moves from the developer carrying member to the photosensitive member by the development field.

For this reason, in order to reduce the carrier remains in the image forming apparatus having a process speed of not less than 300 mm/s, development of an image forming method has been desired in which a recorded image having a desired density can be output while a peak-to-peak voltage Vpp of the AC component in the developing bias is not more than 1.3 kV.

In the image forming method using the two component developing system, electrical properties of the magnetic carrier have a great influence on the local electric field applied to the magnetic carrier particles and the electrostatically adhering toner particles. Accordingly, in the two component developing system, the developability depends on the electrical properties of the magnetic carrier. In the related art, attempts have been made to improve the developability by adjusting the electrical properties of the magnetic carrier based on such a phenomenon. Particularly recently, in order to avoid irregularities in the latent image caused by reduction in the resistance of the magnetic carrier, a method has been proposed in which the permittivity of the magnetic carrier is increased to improve the developability while the image quality is kept.

For example, a method has been proposed in which the magnetic carrier contains a permittivity material; thereby, the developability is improved and a desired image density is ensured while the electric resistance of the magnetic carrier is kept high to reduce the charges to be injected into the electrostatic image.

Japanese Patent Application Laid-Open No. S60-19157 and Japanese Patent Application Laid-Open No. H10-83120 propose a magnetic carrier coated with a high resistance substance, wherein the high resistance substance contains a high permittivity substance; thereby, high reproductivity of a high density portion and a halftone is provided while the electric resistance of the magnetic carrier is kept high. Unfortunately, in the method for dispersing a permittivity material in a high resistance coating material, if printing is performed for a certain period of time or longer, wear of the coating layer reduces the effect of the permittivity material. For this reason, the developability is reduced, leading to reduction in the image density and poor granularity in an output image. Moreover, coating of the surface of the magnetic carrier with a high resistance substance inhibits movement of the charges between the magnetic carriers. For this reason, charges having an opposite polarity to that of the toner may be accumulated within the magnetic carrier during development of the toner, and the magnetic carrier may adhere onto a blank area of the photosensitive member, causing image defects.

Moreover, Japanese Patent Application Laid-Open No. 2007-102052 proposes a magnetic body dispersing type resin carrier having a magnetic particle dispersed in a resin, wherein a high resistance substance having a relative permittivity of not less than 80 is dispersed in a binder resin; thereby, an image having a stable density can be output for a long period of time while the resistance of the magnetic carrier is kept high. Unfortunately, in the method for producing a magnetic carrier core by dispersing the magnetic material and the permittivity material in the binder resin, the amount of the magnetic particle to be dispersed in the binder resin is limited, and the amount of the magnetic carrier to be magnetized cannot be increased. If the process speed is higher, problems occur, i.e., the transportability of the developer is reduced, or part of the magnetic carrier adheres onto the photosensitive member, causing image defects such as the remains of the magnetic carrier appearing on the image.

Moreover, the high permittivity material used for the magnetic carrier above is more expensive than the magnetic materials and resin materials used in the magnetic carrier in the related art. The problem of production cost is left unsolved in use of the high permittivity material having high quality in order to obtain the effect of permittivity.

Another method for improving developability has been proposed in which without using a permittivity material, an electrically conductive path in the magnetic carrier under the development field is controlled to increase the effective permittivity.

For example, Japanese Patent Application Laid-Open No. 2010-170106 proposes a method for improving developability in which in a resin-filled type ferrite magnetic carrier obtained by filling pores of a porous ferrite particle with a resin, a state of the contact between the porous ferrite components in the ferrite particle is varied to control the electrically conductive path of the magnetic carrier and increase the permittivity substantially. Unfortunately, in the method for varying an inner contact state of porous ferrite particles at a certain level or more, which is proposed in Japanese Patent Application Laid-Open No. 2010-170106, even particle diameter distribution needs to be managed, and it is difficult to keep production stability and to produce a magnetic carrier having stable properties. Further, a raw material ferrite having different center particle diameters or particle diameter distribution needs to be produced, leading to a complicated production process. Accordingly, the method is not suitable for reduction in production cost.

Japanese Patent Application Laid-Open No. 2007-218955 proposes a magnetic core having micropores inside thereof, the magnetic core having a magnetic phase as ferrite and a non-magnetic phase containing one or more of $SiO_2$, $Al_2O_3$, and $Al(OH)_3$ as a unit for increase the resistance of the magnetic core. By use of the magnetic core having a magnetic phase as ferrite and a compound having a non-magnetic phase, keeping the resistance of the magnetic carrier high is improved, and reduction in the image quality by the charge injection is prevented. Unfortunately, the structure having a non-magnetic phase obstructs increase in mass susceptibility of the magnetic carrier. For this reason, if the process speed is higher, part of the magnetic carrier adheres onto the photosensitive member, causing image defects such as the remains of the magnetic carrier appearing on the image.

As above, the methods proposed in the related art do not sufficiently solve the various problems. Accordingly, an image forming method has been desired in which the electrostatic latent image bearing member has a surface circumferential speed (process speed) of not less than 300 mm/s, the peak-to-peak voltage of the AC component in the developing bias is not more than 1.3 kV, and a high density recorded image without carrier remains can be output.

SUMMARY OF THE INVENTION

An object of the present invention is to provide an image forming method using the two component developing system, wherein in an image forming apparatus, a print speed is not less than 300 mm/s, a peak-to-peak voltage Vpp of an AC component in a developing bias is not more than 1.3 kV, a sufficient image density is ensured, and the amount of a carrier adhering onto a photosensitive member is reduced to output a recorded image having high image quality.

As a result of extensive research by the present inventors in order to develop a magnetic carrier having high developability and image properties, and high production stability at low cost, high developability can be ensured by using a magnetic carrier in which electrical properties of the crystals in ferrite in the magnetic core and electrical properties at a grain boundary can be controlled to improve dielectric properties under a development field, and a high quality recorded image without remains of the magnetic carrier can be output while the process speed is not less than 300 mm/s, and the peak-to-peak voltage Vpp of the AC component in the developing bias is not more than 1.3 kV.

Namely, the present invention relates to an image forming method (a first aspect), the image forming method including: forming an electrostatic latent image on a surface of an electrostatic latent image bearing member, and developing the electrostatic latent image formed on the surface of the electrostatic latent image bearing member using a two component developer carried on a developer carrying member to form a toner image, wherein in the development, a surface circumferential speed of the electrostatic latent image bearing member is not less than 300 mm/s, a developing bias is applied to the developer carrying member, the developing bias including a DC electric field and an alternating electric field superimposed on the DC electric field, and a peak-to-peak voltage of an AC component in the developing bias is not more than 1.3 kV; the two component developer contains a toner and a magnetic carrier; the magnetic carrier contains a magnetic core and a resin, and the magnetic core is a ferrite containing Sr and Ca; and in a backscattered electron image of a cross section of the magnetic carrier captured by a scanning electron microscope, i) an area ratio of a ferrite portion is not less than 0.70 and not more than 0.90, and ii) a number average area of the crystal is not less than 2.0 $\mu m^2$ and not more than 7.0 $\mu m^2$.

According to the image forming method according to the present invention, a recorded image having a high density and having less carrier remains on the image can be output in the image forming method using the two component developing system wherein the process speed is not less than 300 mm/s, the peak-to-peak voltage of the AC component in the developing bias including a DC electric field and an alternating electric field superimposed on the DC electric field is not more than 1.3 kV.

Further features of the present invention will become apparent from the following description of exemplary embodiments with reference to the attached drawings.

DESCRIPTION OF THE EMBODIMENTS

Figure 1:
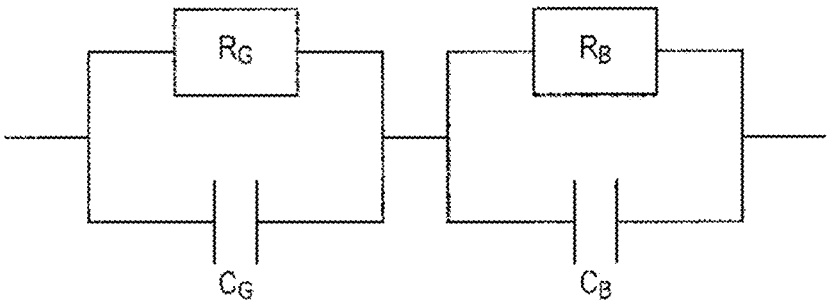
FIG. 1 is a drawing illustrating an equivalent circuit model showing electrical properties of a magnetic core and a magnetic carrier.

Preferred embodiments of the present invention will now be described in detail in accordance with the accompanying drawings.

The image forming method according to the present invention includes forming an electrostatic latent image on a surface of an electrostatic latent image bearing member, and developing the electrostatic latent image formed on the surface of the electrostatic latent image bearing member using a two component developer carried on a developer carrying member to form a toner image, wherein in the development, the surface circumferential speed of the electrostatic latent image bearing member is not less than 300 mm/s, a developing bias is applied to the developer carrying member, the developing bias including a DC electric field and an alternating electric field superimposed on the DC electric field, and a peak-to-peak voltage of an AC component in the developing bias is not more than 1.3 kV. The upper limit value of the surface circumferential speed of the electrostatic latent image bearing member is practically 1000 mm/s, and the lower limit value of the peak-to-peak voltage of the AC component in the developing bias is practically 0.5 kV.

Hereinafter, the gist of the present invention will be described.

By adding a proper amount of a Sr compound and a proper amount of a Ca compound to a ferrite raw material at the same time, and properly controlling the temperature raising rate and the cooling rate during burning of the magnetic core, the present inventors can reduce the pore volume while crystal growth of ferrite in the magnetic core particle is suppressed. Namely, in the magnetic carrier according to the present invention, in the backscattered electron image of a cross section of the magnetic carrier captured by a scanning electron microscope, the area ratio of a ferrite portion needs to be not less than 0.70 and not more than 0.90, and the number average area of the crystal needs to be not less than 2.0 $\mu m^2$ and not more than 7.0 $\mu m^2$. Thereby, the developability can be improved compared to the magnetic carrier in the related art.

In ferrite contained in the magnetic carrier according to the present invention, a high concentration of Sr is concentrated at an interface between crystal grains, i.e., the so-called grain boundary, and forms a high resistance layer. For this reason, a structure can be provided in which the grain boundary accumulates charges as a capacitor. Moreover, if a large number of the crystal grains exist in a high density in the core particle, the total area of the grain boundary in the core particle is increased, and the entire core particle has a capacitance of the grain boundary as a capacitor significantly larger than that of the magnetic core in the related art.

In the magnetic carrier according to the present invention, the electric resistance of the magnetic core is reduced under the electric field. Thereby, the charges easily move within the magnetic core particle to increase the amount of the charges to be accumulated in the capacitor at the grain boundary, and the effective capacitance is effectively increased.

It is thought that the developability is improved compared to that in the magnetic carrier in the related art because the properties above of the magnetic carrier significantly increases the capacitance of the magnetic carrier under the development field, thereby increasing electric field intensity applied to the toner particle carried on the magnetic carrier.

In the related art, methods are known in which in order to improve magnetic properties of ferrite and control crystal growth during sintering, a slight amount of a Sr compound is added to a ferrite raw material, or a slight amount of a Ca compound is added to a ferrite raw material. For example, the ferrite containing Sr easily forms magnetoplumbite type crystal having a unit cell having SrO.6 ($Fe_2O_3$). For this reason, addition of a slight amount of Sr facilitates suppression of the crystal growth speed of ferrite. Moreover, Ca is likely to be segregated at the grain boundary at a high concentration. For this reason, addition of a slight amount of Ca improves the magnetic properties such as reduction in the eddy current loss under the magnetic field that changes at a high frequency. These are described in "Ferrite" written by Teitaro Hiraga, Katsunobu Okutani, and Teruhiko Ojima (published by Maruzen, Co., Ltd.).

In the research by the present inventors, however, in the case where only Sr is added to ferrite, most of Sr forms a paramagnetic magnetoplumbite phase. For this reason, residual magnetization is likely to be produced in the magnetic carrier, leading to reduction in fluidity of the two component developer, adhesion of the magnetic carrier onto the photosensitive member in a chain form, or production of remarkable defects on an image. In the case where only Ca is added to ferrite, the effect of the grain boundary as a capacitor is reduced, and large capacitance cannot be produced in the magnetic core.

As a result of further research, it was found out that Sr and Ca are added to ferrite at the same time, and the temperature during burning of the magnetic core is controlled such that the temperature is mildly raised during raising of the temperature from 600° C. to 900° C., the temperature is rapidly raised during raising of the temperature from 900° C. to a peak temperature, and the temperature is rapidly cooled during cooling from the peak temperature to 600° C.; thereby, the paramagnetic magnetoplumbite phase is reduced, and a high concentration of Sr is segregated at the grain boundary to form a capacitor at the grain boundary.

Namely, the magnetic core in the magnetic carrier according to the present invention can have an extremely large capacitance of the magnetic carrier under the development field to improve the developability because crystals having a small grain diameter exist in a high density in the magnetic core particle to form a grain boundary having a large area, and a high density of Sr is concentrated at the grain boundary to form a capacitor.

Usually, an electric conduction model of a polycrystalline sintered body is represented by an equivalent circuit model in which a crystal is connected to the grain boundary in series (see FIG. 1). In FIG. 1, $R_G$ is an electric resistance of the crystal, $C_G$ is a capacitance of the crystal, $R_B$ is an electric resistance of the grain boundary, and $C_B$ is a capacitance of the grain boundary.

In the present invention, the capacitance of the grain boundary is extremely increased, and the charges are accumulated in the grain boundary. Thereby, the effective capacitance of the magnetic carrier under the development field can be increased to improve the developability. Namely, the ratio of the capacitance $C_B$ of the grain boundary to the capacitance $C_G$ of the crystal having a capacitance equal to that of the ferrite carrier in the related art, namely, $C_B/C_G$ can be large. At $C_B/C_G$ less than 100, the development field intensity applied to the toner particle carried on the magnetic carrier particle is not sufficiently increased, leading to difficulties of outputting a recorded image having a desired image density. Accordingly, $C_B/C_G$ can be not less than 100.

In the present invention, the electric resistance of the magnetic core under the electric field is reduced to facilitate movement of the charges in the magnetic core. Thereby, the charges can be efficiently accumulated in the grain boundary acting as a capacitor. Thereby, the effective capacitance of the magnetic carrier can be increased under the development field to further improve the developability.

Usually, it is thought that electrical conduction in ferrite is governed by hopping conduction in which electrons move by replacement of $Fe^{2+}$ and $Fe^{3+}$ in the crystal. For this reason, properties of the electric resistance R of the magnetic core with respect to applied electric field intensity E follow the Poole-Frenkel expression, and are represented by the expression (6) below:

$$R(E) \propto \exp(-K\sqrt{E}) \tag{6}$$

wherein K is a positive constant. From the expression (6), as K is larger, the electric resistance is more reduced under the electric field. Namely, in the expression (6), K can be not less than 0.010 from the viewpoint of facilitating the movement of the charges in the magnetic core and accumulating the charges in the capacitor at the grain boundary. At K not less than 0.015, the electric resistance of the magnetic carrier is extremely reduced, and the charges are injected into the photosensitive member, causing problems such as irregularities in the latent image or adhesion of the magnetic carrier onto the photosensitive member. Accordingly, K can be not more than 0.015.

In the equivalent circuit in the electric conduction model in the polycrystalline sintered body (FIG. 1), frequency properties of the complex capacitance C* is represented as in the expression (7):

$$C^*(\omega) = C_\infty + \frac{C_S - C_\infty}{1 + i\omega\tau} + \frac{1}{i\omega R} \tag{7}$$

wherein there is a correspondence as follows:

$$\begin{cases} R = R_G + R_{GB} \\ \tau = \dfrac{C_G + C_{GB}}{R_G^{-1} + R_{GB}^{-1}} \\ C_\infty = \dfrac{1}{C_G^{-1} + C_{GB}^{-1}} \\ C_S = \dfrac{R_G^2 C_G + R_{GB}^2 C_{GB}}{(R_G + R_{GB})^2} \end{cases} \tag{8}$$

Here, ω is an angular frequency, $C_\infty$ is a convergence value of the capacitance when ω is brought close to infinity, i.e. ∞, $C_S$ is a convergence value of the capacitance when ω is brought close to zero, and there is a relationship of $C_\infty \leq C_S$. τ is a relaxation time in dielectric relaxation, and R is a DC resistance value. These are described in "Impedance Spectroscopy" (published by Wiley Interscience) written by Evgenij Barsoukov, and J. Ross Macdonald.

According to the research by the present inventors, however, in the magnetic carrier according to the present invention, the relaxation constant is distributed around the median τ, and frequency properties of a complex capacitance C* (ω) behave as in the expression (1). α in the expression (1) corresponds to the size of the breadth of the distribution of the relaxation time in dielectric relaxation formed between the crystal and the grain boundary, and the breadth of the distribution of the relaxation constant is smaller as the value α is smaller. It is thought that the breadth of the distribution of the relaxation time is produced by variation in the electric resistance among the crystals in ferrite.

Figure 2:
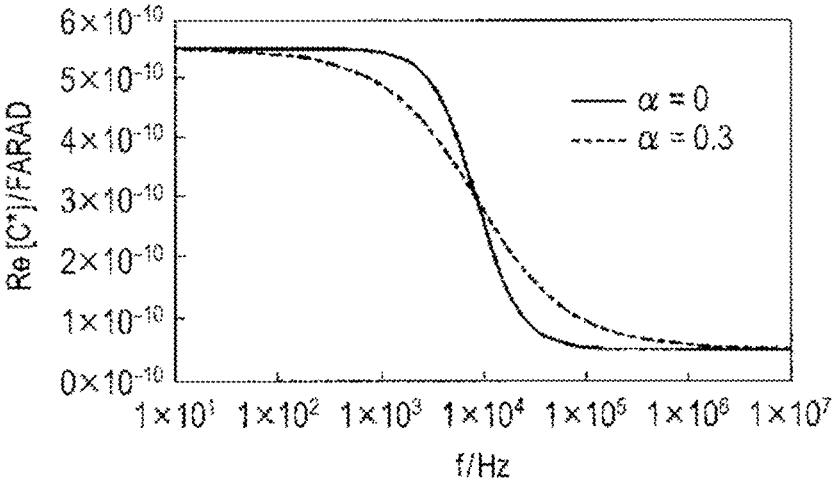
FIG. 2 is a schematic view illustrating the difference in a dielectric relaxation property of a capacitance according to distribution of a relaxation time.

FIG. 2 is a graph illustrating properties of the real part Re [C*] in the complex capacitance C* with respect to a frequency f [Hz] in the expression (1) and the expression (7). The solid line designates the dielectric relaxation property of the capacitance in the expression (7), and the dotted line designates the dielectric relaxation property of the capacitance at α=0.30 in the expression (1). From FIG. 2, it can be understood that if the breadth of the distribution of the relaxation constant is large, transition of the capacitance from $C_\infty$ to $C_S$ becomes slow. From this, if variation in the electric resistance among the crystal grains exists, accumulation of the charges in the grain boundary is varied, and the capacitance as the magnetic carrier particle becomes smaller than in the case where no variation is found in the electric resistance among the crystal grains.

In the present invention, from the viewpoint of efficiently improving the capacitance under the electric field, variation in the electric resistance among the crystal grains can be reduced to reduce the value α that represents the breadth of the distribution of the relaxation time in the dielectric relaxation. At α more than 0.30, a speed of accumulating the charges in the capacitor at the grain boundary is varied, and the development field intensity applied to the toner particle carried on the magnetic carrier particle is not sufficiently increased. Accordingly, a recorded image having a desired image density is difficult to output. For this reason, α can be not more than 0.30.

The magnetic carrier according to the present invention can be used by coating the magnetic core with a resin for the purpose of adjusting the electric resistance of the magnetic carrier, holding an ability to give charges to the magnetic carrier, adjusting the fluidity as the two component developer, and the like.

In the magnetic carrier containing the magnetic core, in order to increase the capacitance under the development field to improve the developability, the magnetic carrier can be produced by reducing an influence on the electrically conductive path by the coating resin, and holding the capacitance properties of the magnetic core. Namely, as electrical properties, the magnetic carrier can also have a large value of the ratio $C_B/C_G$ of the capacitance $C_B$ of the grain boundary to the capacitance $C_G$ of the crystal in the magnetic carrier, the ratio being calculated using the same measurement and analysis method as those in the case of the magnetic core. At $C_B/C_G$ less than 20, the development field intensity applied to the toner particle carried on the magnetic carrier particle is not sufficiently increased, and a recorded image having a desired image density is difficult to output. Accordingly, $C_B/C_G$ can be not less than 20.

Hereinafter, an embodiment of the two component developer used in the image forming method according to the present invention will be described in detail.

<Magnetic Carrier According to the Present Invention>

Ferrite contained in the magnetic core contained in the magnetic carrier according to the present invention is a sintered body represented by the following composition formula:

$$(MeO)w(SrO)x(CaO)y(Fe_2O_3)z$$

Me is a divalent metal element. Me can be one or more metal atoms selected from the group consisting of Fe, Mn, Mg, Cu, Zn, Ni, and Co. The ferrite may contain a slight amount of other metal.

From the viewpoint of easy control of the crystal growth speed, more preferable are Mn-based ferrite and Mn-Mg-based ferrite containing Mn.

From the viewpoint of magnetizing properties and electric conductivity of the ferrite crystal formed by burning, z in the composition formula can be not less than 0.40 and not more than 0.70 in the composition ratio of Fe.

From the viewpoint of segregating Sr at the grain boundary to form the capacitor, x in the composition formula can be not less than 0.010 and not more than 0.030 in the composition ratio of Sr. As the composition ratio of Ca needed to reduce the magnetoplumbite phase, and segregate Sr at the grain boundary, y in the composition formula can be not less than 0.0050 and not more than 0.015.

Figure 3:
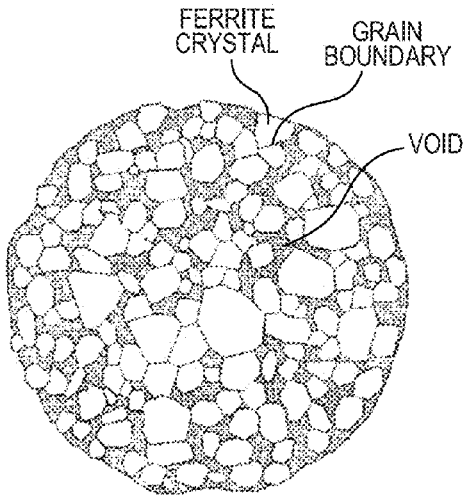
FIG. 3 is a schematic view illustrating a cross section of a magnetic carrier according to the present invention.

In order to increase the total area of the grain boundary in the magnetic core particle, the area ratio of a ferrite portion in a cross section of the magnetic carrier needs to be not less than 0.70 and not more than 0.90. The number average area of the ferrite crystal (grain) needs to be not less than 2.0 $\mu m^2$ and not more than 7.0 $\mu m^2$ (see FIG. 3). If such a structure is provided, the capacitance of the capacitor at the grain boundary can be extremely increased.

In the magnetic carrier coated with a coating resin, in order to hold the capacitance properties of the magnetic core, as the electrical properties, the coating resin can have a conductivity sufficiently smaller than that of the magnetic core. The reason is as follows: if the coating resin has conductivity larger than that of the magnetic core, the electric conduction within the coating resin is more dominant than the electric conduction within the magnetic core, reducing the effect of the capacitor at the grain boundary in the magnetic core.

Further, in contact between the magnetic carrier particles, the amount of the coating resin to be applied can be adjusted so as not to completely inhibit the charge moving path between the magnetic carrier particles because the charges are accumulated in the capacitance of the grain boundary by movement of the charges between the particles.

Next, a specific method for producing the magnetic carrier according to the present invention will be described in detail.

—Step 1: Production of Calcined Ferrite Powder—

Step 1-1 (Weighing and Mixing Step):

Ferrite raw materials are weighed, and mixed.

Examples of the ferrite raw materials include: particles of Fe, Mn, Mg, Sr, Ca, and Si, oxides of elements, hydroxides of elements, oxalic acid salts of elements, and carbonates of elements.

Examples of a mixing apparatus include ball mills, planetary ball mills, and Giotto mills. Particularly, a wet ball mill using a slurry having a solid content in a concentration of 60% by mass to 80% by mass in water can be used in order to obtain mixability.

Step 1-2 (Calcination Step):

The mixed ferrite raw material is granulated and dried using a spray dryer. Then, the ferrite raw material is calcined in the air at a temperature of not less than 700° C. and not more than 1000° for not less than 1.5 hours and not more than 5.0 hours to turn the raw material into ferrite. When the temperature exceeds 1000° C., sintering progresses, and the ferrite may be difficult to crush into a particle diameter for reducing the crystal grain diameter.

Step 1-3 (Crushing Step):

The calcined ferrite produced in Step 1-2 is crushed by a mill. Examples of the mill include crushers, hammer mills, ball mills, bead mills, planetary ball mills, and Giotto mills. In the pulverized product of the calcined ferrite, the volume-based 50% particle diameter (D50) can be not less than 0.5 μm and not more than 3.0 μm.

In order to provide the particle diameter in the crushed powder of the calcined ferrite, the material for a ball or a bead to be used, and the operation time can be controlled in the ball mill and the bead mill. Specifically, in order to reduce the particle diameter of the calcined ferrite, a ball having a large specific gravity may be used, and the crushing time may be longer. The material for a ball or a bead is not particularly limited as long as a desired particle diameter is obtained.

Examples of the material for a ball or a bead include: glasses such as soda-lime glass (specific gravity of 2.5 g/cm$^3$), sodaless glass (specific gravity of 2.6 g/cm$^3$), and high specific gravity glass (specific gravity of 2.7 g/m$^3$), quartz (specific gravity of 2.2 g/cm$^3$), titania (specific gravity of 3.9 g/cm$^3$), silicon nitride (specific gravity of 3.2 g/cm$^3$), alumina (specific gravity of 3.6 g/cm$^3$), zirconia (specific gravity of 6.0 g/cm$^3$), steel (specific gravity of 7.9 g/cm$^3$), and stainless steel (specific gravity of 8.0 g/cm$^3$). Among these, alumina, zirconia, and stainless steel can be used because these have high resistance to wear.

The particle diameter of the ball or the bead is not particularly limited as long as a desired crushed particle diameter is obtained. For example, a ball having a diameter of not less than 5 mm and less than 20 mm is suitably used. A bead having a diameter of not less than 0.1 mm and less than 5 mm is suitably used.

Wet ball mills and wet bead mills like a slurry using water are more preferable than dry ones because these have high crushing efficiency and are easy to control.

—Step 2: Production of Magnetic Core—

Step 2-1 (Granulation Step):

Water and a binder are added to the pulverized product of the calcined ferrite to prepare a ferrite slurry. When necessary, a foaming agent, organic fine particles, and $Na_2CO_3$ are added as a pore adjuster. As the binder, for example, polyvinyl alcohol is suitably used.

In Step 1-3, in the case of using wet crushing, water contained in the ferrite slurry is considered, and a binder and when necessary, a pore adjuster can be added. In order to control the particle diameter of the magnetic core, the concentration of the solid content in the slurry can be not less than 50% by mass and not more than 80% by mass, and granulation is performed.

The obtained ferrite slurry is granulated and dried using a spray drying machine under a heating atmosphere at not less than 100° C. and not more than 200° C. As the spray drying machine, a spray dryer can suitably be used because the particle diameter of the magnetic core can be controlled to be a desired diameter. The magnetic core particle diameter can be controlled by properly selecting the number of rotation of the disk used in the spray dryer or a spray amount.

Step 2-2 (Main Calcination Step):

Next, the granulated product is burned at a temperature of not less than 1000° C. and not more than 1200° C. for not less than 2 hours and not more than 12 hours.

The burning temperature and the burning time are adjusted within the ranges according to the composition and particle diameter of the calcined ferrite. Thereby, segregation of Sr at the grain boundary is promoted, and the pore volume can be reduced while enlargement of the crystals is suppressed. In order to promote segregation of Sr at the grain boundary, during raising of the temperature, for example, the temperature is mildly raised when the temperature is raised from 600° C. to 900° C., and the temperature is rapidly raised during raising of the temperature from 900° C. to the peak temperature. During cooling, crystallization rapidly progresses, and the crystal grain diameter tends to be enlarged. For this reason, cooling can be rapidly performed when the temperature is cooled from the peak temperature to 600° C. to control enlargement of the crystal. Specifically, the temperature raising rate can be 110 to 140° C./hour during raising of the temperature from 600° C. to 900° C., the temperature raising rate can be 180 to 210° C./hour during raising of the temperature from 900° C. to the peak temperature. The cooling rate can be 130 to 180° C./hour during cooling of the temperature from the peak temperature to 600° C.

A lower resistance can be given to the magnetic core by adjusting the burning atmosphere, and burning under a reduction atmosphere. The burning atmosphere can be a nitrogen atmosphere in which the concentration of oxygen is not less than 0.1% and not more than 0.5%.

The main calcination is performed under such burning conditions. Thereby, Sr can be segregated at the grain boundary, and a ferrite sintered body can be produced in which crystals having a small grain diameter are disposed in a high density.

Step 2-3 (Selection Step):

The thus burned particle is pulverized, and when necessary, the crushed product can be used after sieving and removing coarse particles and fine particle by classification or a sieve. Further, a feeble magnetic particle can be removed by a magnetic sorting machine.

—Step 3: Production of Magnetic Carrier—

In the case where the pore volume in the magnetic core produced in Step 2 is large, pores between the magnetic cores may be filled with a resin in order to provide proper mechanical strength, electric resistance, and magnetic properties as the magnetic carrier.

The method for filling pores between the magnetic cores with a resin is not particularly limited, and can be a method for allowing a resin solution prepared by mixing a resin with a solvent to permeate into the pores between the magnetic core particles.

The amount of the resin solid content in the resin solution is preferably not less than 1% by mass and not more than 20% by mass, and more preferably not less than 2% by mass and not more than 10% by mass. By use of a resin solution having a solid content of not more than 20% by mass, the viscosity is not increased, and the resin solution easily uniformly permeates into micropores between the ferrite core particles. A solid content of not less than 1% by mass, a volatilizing rate of the solvent is not excessively slow, and uniform filling with the resin can be achieved.

The resin filling the pores between the magnetic cores is not particularly limited, and any of thermoplastic resins and thermosetting resins may be used. Desirable is those having high affinity with the magnetic core. If the resin having high affinity is used, the surface of the magnetic core is easily covered with the resin at the same time when the pores between the magnetic cores are filled with the resin.

Examples of the thermoplastic resins include: polystyrene, polymethyl methacrylate, and styrene-acrylic resins; styrene-butadiene copolymers, ethylene-vinyl acetate copolymers, polyvinyl chloride, polyvinyl acetate, polyvinylidene fluoride resins, fluorocarbon resins, perfluorocarbon resins, polyvinylpyrrolidone, petroleum resins, novolak resins, saturated alkyl polyester resins, polyethylene terephthalate, polybutylene terephthalate, polyarylate, polyamide resins, polyacetal resins, polycarbonate resins, polyethersulfone resins, polysulfone resins, polyphenylene sulfide resins, and polyether ketone resins.

Examples of the thermosetting resins include: phenol resins, modified phenol resins, maleic resins, alkyd resins, epoxy resins, unsaturated polyesters obtained by polycondensation of maleic anhydride, terephthalic acid, and polyhydric alcohol, urea resins, melamine resins, urea-melamine resins, xylene resins, toluene resins, guanamine resins, melamine-guanamine resins, acetoguanamine resins, glyptal resins, fran resins, silicone resins, modified silicone resins, polyimides, polyamidimide resins, polyetherimide resins, and polyurethane resins.

The modified resins of these may be used. Among these, fluorine-containing resins such as polyvinylidene fluoride resins, fluorocarbon resins, perfluorocarbon resins, or solvent-soluble perfluorocarbon resins, modified silicone resins, or silicone resins can be used because these have high affinity with the ferrite core particle.

Among the resins above, particularly preferable are silicone resins. Known silicone resins in the related art can be used.

Examples of the commercial product include as follows. Examples of silicone resins include KR271, KR255, and KR152 made by Shin-Etsu Chemical Co., Ltd., and SR2400, SR2441, SR2440, and SR2406 made by Dow Corning Toray Co., Ltd. Examples of modified silicone resins include KR5206 (alkyd modified), KR9706 (acrylic modified), and ES1001N (epoxy modified) made by Shin-Etsu Chemical Co., Ltd.

A silane coupling agent may be added to the silicone resin as a charge control agent. The amount of the silane coupling agent to be added is not less than 1 part by mass and not more than 50 parts by mass based on 100 parts by mass of the resin solid content.

Examples thereof include γ-aminopropyltrimethoxysilane, γ-aminopropylmethoxydiethoxysilane, γ-aminopropyltriethoxysilane, N-β-(aminoethyl)-γ-aminopropyltrimethoxysilane, N-β-(aminoethyl)-γ-aminopropylmethyldimethoxysilane, N-phenyl-γ-aminopropyltrimethoxysilane, ethylenediamine, ethylenetriamine, styrene-dimethylaminoethyl (meth)acrylate copolymers, isopropyl tri(N-aminoethyl)titanate, hexamethyldisilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane, and p-methylphenyl trimethoxysilane.

As a method for filling pores between the magnetic cores with a resin, a method can be used in which a resin is dissolved in a solvent, and the solution is added to pores between the ferrite core particles. The solvent used here may be any solvent that can dissolve the resin. In the case of resins soluble in an organic solvent, examples of organic solvents include toluene, xylene, butyl cellosolve acetate, methyl ethyl ketone, methyl isobutyl ketone, and methanol. In the case of a water-soluble resin or an emulsion type resin, water may be used as the solvent. Examples of the method for filling pores between the magnetic cores with a resin include a method in which a ferrite core particle is impregnated with a resin solution by an application method such as a dipping method, a spray method, a brush coating method, and a fluidized bed, and the solvent is volatilized.

Step 3-2 (Coating Step):

In the case where the magnetic core produced in Step 2 has a small volume of pores inside of the magnetic core, and the magnetic carrier has proper mechanical strength, the surface of the magnetic core can be coated with a coating resin. By adjusting the amount of the coating resin to be applied, the electric resistance as the magnetic carrier can be controlled.

In the case of the magnetic carrier in which pores between the ferrite core particles are filled with a resin in Step 3-1, the surface of the magnetic core can be further coated with a coating resin. By adjusting the amount of the coating resin to be applied, the electric resistance as the magnetic carrier can be controlled. In this case, the resin used for filling and the resin used for coating as a coating material may be the same or different, and may be a thermoplastic resin or a thermosetting resin.

As the resin that forms the coating material, a thermoplastic resin or a thermosetting resin may be used. Alternatively, a curing agent and the like may be added to a thermoplastic resin, and the thermoplastic resin may be cured and used. A resin having higher releasability is suitably used.

The coating material may further contain a conductive particle, and a particle or material having charge controllability.

Examples of the conductive particle include carbon black, magnetite, graphite, zinc oxide, and tin oxide.

The content of the conductive particle in the coating layer can be not less than 2 parts by mass and not more than 80 parts by mass based on 100 parts by mass of the coating resin.

Examples of the particle having the charge controllability include particles of organic metal complexes, particles of organic metal salts, particles of chelate compounds, particles of monoazo metal complexes, particles of acetylacetone metal complexes, particles of hydroxycarboxylic acid metal complexes, particles of polycarboxylic acid metal complexes, particles of polyol metal complexes, particles of polymethyl methacrylate resins, particles of polystyrene resins, particles of melamine resins, particles of phenol resins, particles of nylon resins, particles of silica, particles of titanium oxide, and particles of alumina.

The content of the particle having charge controllability in the coating layer can be not less than 2 parts by mass and not more than 80 parts by mass based on 100 parts by mass of the coating resin.

As a method for coating the surface with a resin, a method of coating using an application method such as a dipping method, a spray method, a brush coating method, and a fluidized bed can be used. Among these, more preferable is the dipping method because the magnetic carrier resistance is controlled to fall within a desired range.

The coating amount can be not less than 0.1 parts by mass and not more than 3.0 parts by mass based on 100 parts by mass of the ferrite core particle because the magnetic carrier resistance is controlled to fall within a desired range.

Desirably, in the magnetic carrier according to the present invention, the 50% particle diameter (D50) based on volume distribution is not less than 20 μm and not more than 60 μm. The D50 within the specific range is preferable from the viewpoint of a frictional charge giving ability to the toner and prevention of adhesion of the magnetic carrier onto the photosensitive member.

The 50% particle diameter (D50) of the magnetic carrier can be adjusted by air classification of the obtained magnetic carrier by wind or sieve classification thereof.

Step 3-3 (Selection Step):

The thus-produced magnetic carrier can be used after sieving and removing coarse particles and fine particles by classification or a sieve when necessary. Further, a feeble magnetic particle can be removed by a magnetic sorting machine.

<Toner According to the Present Invention>

Any known toner can be used together with the magnetic carrier according to the present invention. The toner may be those produced by any method such as a crushing method, a polymerization method, an emulsion aggregation method, and a dissolution suspension method.

Next, materials that form a toner particle containing a binder resin, wax, and a colorant according to the present invention will be described. In the present invention, various known materials for the toner particle can be used.

Examples of the binder resin that forms the toner particle include as follows.

In the toner suitably used in the present invention, examples of the binder resin include polystyrenes; homopolymers of styrene substitutes such as poly-p-chlorostyrene and polyvinyltoluene; styrene copolymers such as styrene-p-chlorostyrene copolymers, styrene-vinyltoluene copolymers, styrene-vinylnaphthalene copolymers, styrene-acrylic acid ester copolymers, styrene-methacrylic acid ester copolymers, styrene-α-chlormethyl methacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene copolymers; polyvinyl chloride, phenol resins, natural modified phenol resins, natural resin-modified maleic acid resins, acrylic resins, methacrylic resins, polyvinyl acetate, silicone resins, polyester resins, polyurethanes, polyamide resins, fran resins, epoxy resins, xylene resins, polyvinyl butyral, terpene resins, coumarone indene resins, and petroleum-based resins. In the present invention, a preferable binder resin is polyester resins because the developability and fixing properties at a low temperature are provided at the same time.

Among physical properties of the toner, one of those attributed to the binder resin is the molecular weight. More preferably, in the molecular weight distribution obtained by measuring a tetrahydrofuran (THF) soluble content by gel permeation chromatography (GPC), the binder resin has at least one peak in the region of a molecular weight of not less than 2,000 and not more than 50,000, and the component having a molecular weight of not less than 1,000 and not more than 30,000 exist in a proportion of not less than 50% and not more than 90% in the binder resin.

In the toner suitably used in the present invention, from the viewpoint of improvement in releasability from a fixing member during fixing and improvement in fixing properties, wax shown below is used as the material for the toner particle. Examples of the wax include paraffin wax and derivatives thereof, microcrystalline wax and derivatives thereof, Fischer-Tropsch wax and derivatives thereof, polyolefin wax and derivatives thereof, and carnauba wax and derivatives thereof. Examples of the derivatives of these waxes include oxides, block copolymers with vinyl monomers, and graft modified products. Examples of the wax include alcohols, fatty acids, acid amides, esters, ketones, hydrogenated castor oil and derivatives thereof, plant waxes, animal waxes, mineral waxes, and petrolatum.

In the toner suitably used in the present invention, in order to control the charging amount and charging amount distribution of the toner particle, a charge control agent can be compounded (internally added to) with the toner particle, or mixed with (externally added to) the toner particle, and used.

Examples of a negative charge control agent used to control the toner to have negative charging properties include organic metal complexes and chelate compounds.

Examples of the organic metal complexes include monoazo metal complexes, acetylacetone metal complexes, aromatic hydroxycarboxylic acid metal complex, and aromatic dicarboxylic acid metal complexes. Further, examples of the negative charge control agent include aromatic hydroxycarboxylic acids, aromatic monocarboxylic acids, and aromatic polycarboxylic acids and metal salts thereof; anhydrides of aromatic hydroxycarboxylic acids, aromatic monocarboxylic acids, and aromatic polycarboxylic acids; ester compounds of aromatic hydroxycarboxylic acids, aromatic monocarboxylic acids, and aromatic polycarboxylic acids; and phenol derivatives such as bisphenols.

Examples of a positive charge control agent used to control the toner to have positive charging properties include nigrosines and nigrosines modified with a fatty acid metallic salt; quaternary ammonium salts such as tributylbenzylammonium-1-hydroxy-4-naphthosulfonic acid salts and tetrabutylammonium tetrafluoroborate, and lake pigments thereof; phosphonium salts such as tributylbenzylphosphonium-1-hydroxy-4-naphthosulfonic acid salts and tetrabutylphosphonium tetrafluoroborate, and lake pigments thereof; triphenylmethane dyes and lake pigments thereof (examples of the laking agent include phosphorus tungstate, phosphorus molybdate, phosphorus tungsten molybdate, tannic acid, lauric acid, gallic acid, ferricyanides, and ferrocyanides); and metal salts of high fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate.

These charge control agents can be used singly or in combinations of two or more. A charge control resin can also be used, and used in combination with the charge control agent.

The charge control agent can be used in a form of a fine particle. In the case where these charge control agents are internally added to the toner particle, the amount of the charge control agents to be added to the toner particle is preferably not less than 0.1 parts by mass and not more than 20.0 parts by mass, and particularly preferably not less than 0.2 parts by mass and not more than 10.0 parts by mass based on 100 parts by mass of the binder resin.

In the toner suitably used in the present invention, a variety of colorants known in the related art can be used as the material for the toner particle. As the colorant used in the present invention, a black colorant is a combination of magnetite, and chromatic color colorants such as carbon black, yellow colorants, magenta colorants, and cyan colorants shown below to produce a black color.

As the yellow colorant, compounds such as condensation azo compounds, isoindolinone compounds, anthraquinone compounds, azo metal complexes, methine compounds, and allylamide compounds are used.

Specifically, examples thereof include C.I. Pigment Yellows 12, 13, 14, 15, 17, 62, 74, 83, 93, 94, 95, 97, 109, 110, 111, 120, 127, 128, 129, 147, 155, 162, 168, 174, 176, 180, 181, and 191.

As the magenta colorant, condensation azo compounds, diketo-pyrrolo-pyrrole compounds, anthraquinones, quinacridone compounds, basic dye lake compounds, naphthol compounds, benzimidazolone compounds, thioindigo compounds, and perylene compounds are used.

Specifically, examples thereof include C.I. Pigment Reds 2, 3, 5, 6, 7, 23, 31, 48:2, 48:3, 48:4, 57:1, 81:1, 122, 144, 146, 150, 166, 169, 177, 184, 185, 202, 206, 220, 221, 238, and 254.

As the cyan colorant, copper phthalocyanine compounds and derivatives thereof, anthraquinone compounds, and basic dye lake compounds are used. Specifically, examples thereof include C.I. Pigment Blues 1, 7, 15, 15:1, 15:2, 15:3, 15:4, 60, 62, and 66.

These colorants can be used singly, or used by mixing these, and used even in a state of a solid solution. In the present invention, the colorant is selected considering a hue angle, saturation, lightness, weatherability, OHP transparency, and dispersibility in the toner.

The total amount of these non-magnetic colorants contained in the toner particle is not less than 1.0 part by mass and not more than 20.0 parts by mass based on 100 parts by mass of the binder resin. The total amount of magnetic colorants contained in the toner particle is not less than 20 parts by mass and not more than 60 parts by mass based on 100 parts by mass of the binder resin.

In the toner suitably used in the present invention, an external additive in a form of a fine particle may be externally added. By externally adding the fine particle, fluidity and transferability can be improved. The external additive externally added to the surface of the toner particle can contain one of fine particles of titanium oxide, alumina oxide, and silica fine particles.

The surface of the fine particle contained in the external additive can be hydrophobized. The hydrophobization treatment can be performed by a coupling agent such as a variety of titanium coupling agents and silane coupling agents; fatty acids and metal salts thereof; silicone oil; or a combination thereof.

The content of the external additive in the toner is preferably not less than 0.1% by mass and not more than 5.0% by mass, and more preferably not less than 0.5% by mass and not more than 4.0% by mass. Alternatively, the external additive may be a combination of several kinds of fine particles.

In the case where the magnetic carrier according to the present invention is mixed with the toner to prepare a two component developer, as the mixing ratio, the concentration of the toner in the developer is not less than 2% by mass and not more than 15% by mass, and preferably not less than 4% by mass and not more than 13% by mass. At a mixing ratio above, the toner does not scatter within the apparatus, usually providing a good result.

Hereinafter, the magnetic carrier according to the present invention, various physical property values of the materials that form the magnetic carrier, and method for calculating the property values will be specifically described.

<Capturing Backscattered Electron Image of Cross Section of Magnetic Carrier Particle by Scanning Electron Microscope>

A method for capturing a backscattered electron image of a cross section of the magnetic carrier particle by a scanning electron microscope will be described.

Production of Cross Section Sample of Magnetic Carrier Particle

As a method for producing a cross section sample of the magnetic carrier particle, a usually known method for producing a cross section sample of a particle can be used. Examples thereof include a cross section polisher (CP) method, a fracturing method, a mechanical polishing method, a microtome method, and a focused ion beam (FIB) method.

In the present test example, the cross section sample of the magnetic carrier particle was produced by the mechanical polishing method. Specifically, the magnetic carrier particle was mixed with a G2 epoxy (thermosetting) resin made by Gatan, Inc. The mixture was left at 100° C. for 10 minutes and sufficiently cured. Then, the cured product was polished by an alumina polishing particle (#6000) made by MARUTO INSTRUMENT CO., LTD. to form a smooth surface. Finally, using a 50 nm particle diameter colloidal silica polishing liquid made by Buehler, buffing was performed to produce a cross section of the magnetic carrier particle.

Further, in the present test example, in order to easily discriminate crystal grains in a captured image by a scanning electron microscope, the produced cross section of the magnetic carrier particle was irradiated with an argon ion beam having a broad beam diameter in the vertical direction, and the cross section of the magnetic carrier particle was sputtered. Thereby, the grain boundary was easy to observe. The irradiation conditions of the argon ion beam are shown below:

apparatus: cross section polisher SM-09010 made by JEOL Ltd.
accelerating voltage: 5.0 kV
ion current: 130 μA
irradiation time: 60 seconds Capturing Backscattered Electron Image by Scanning Electron Microscope A backscattered electron image of the produced cross section sample of the magnetic carrier particle was captured by the scanning electron microscope. In the captured image, particles having a diameter of 20 to 40 μm in the cross section of the magnetic carrier particle were particularly selected. Considering variation in the selected particles, images of five particles were captured.

The capturing conditions are shown below:

apparatus: Field Emission Scanning Electron Microscope S4800 made by Hitachi High-Technologies Corporation
accelerating voltage: 1.0 kV
backscattered electron detector: Upper
emission current: 10 μA
lens mode: High <Calculation on Area Ratio of Ferrite Portion and Number Average Area of Crystal in Cross Section of Magnetic Carrier Particle>

Using the captured image of the backscattered electron image of the cross section of the magnetic carrier particle captured under the above conditions and image editing software Photoshop CS5 made by Adobe Systems Incorporated, the area ratio of the ferrite portion and the number average area of the crystal in the cross section of magnetic carrier particle were calculated according to the procedure below.

First, the captured image of the backscattered electron image of the cross section of the magnetic carrier particle was black-and-white converted using the color tone correction function of the software. The threshold of the boundary to be black-and-white converted was determined for each captured image such that the outline of the ferrite portion in the image before black-and-white conversion corresponded to the outline of the ferrite portion after black-and-white conversion. Thus, black-and-white conversion was performed.

Figure 4A:
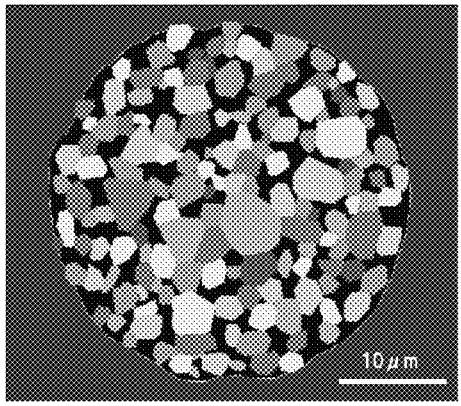
FIG. 4A is a schematic view of a backscattered electron image (a) of a cross section of the magnetic carrier according to the present invention.
Figure 4B:
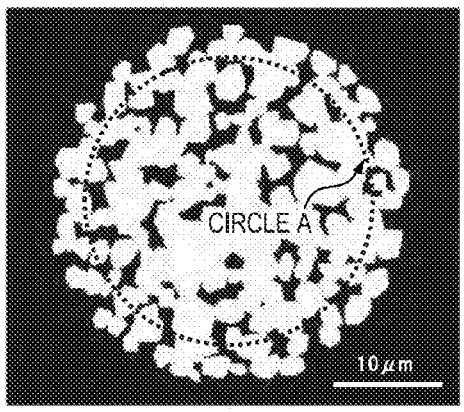
FIG. 4B is a schematic view of a black-and-white converted image (b) thereof.

Further, in the black-and-white converted image, a circle A having 70 to 90% of the diameter of the magnetic carrier particle, and substantially the same center as that of the magnetic carrier particle was selected using an ellipse selecting tool. In the region surrounded by the circle A, the total number of pixels and the number of pixels in the ferrite portion were determined using a histogram function. Then, from the ratio of the number of pixels in the ferrite portion, the area ratio of the ferrite portion in the cross section was determined (see FIGS. 4A and 4B). Further, from comparison with the scale bar displayed on the captured image, the area ($\mu m^2$) of the ferrite portion in the region surrounded by the circle A was calculated.

Figure 5A:
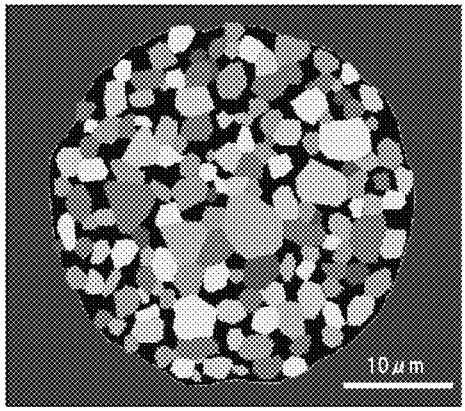
FIG. 5A is a schematic view of a backscattered electron image (a) of a cross section of the magnetic carrier according to the present invention.
Figure 5B:
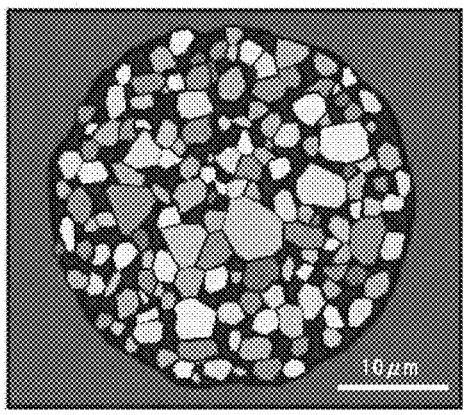
FIG. 5B is a schematic view of an edge-enhanced image (b) thereof.

Next, the captured image of the backscattered electron image of the cross section of the magnetic carrier particle was edge-enhanced using a brush stroke function of the software. The edge-enhancement was performed to enhance the boundary portion in which a difference in contrast of adjacent crystals existed, making it easy to determine whether the grain boundary was present. Thus, crystals were identified one by one (see FIGS. 5A and 5B). The edge-enhancement conditions were as follows: the width of the edge: 1, lightness of the edge: 0, and smoothness: 1.

Further, in the edge-enhanced image, a circle B having the same center and diameter as those of the circle A was selected using the ellipse selecting tool. The number of crystals in the region surrounded by the circle B was counted. The area of the ferrite portion in the region surrounded by the circle A was divided by the number of crystals in the region surrounded by the circle B. Thus, the number average area of the crystal was calculated.

In the present test, in the captured images of the captured five particles, according to the procedure, the area ratio of the ferrite portion and the number average area of the crystal in the cross section of the magnetic carrier particle were calculated, and the average values of the five particles was used.

<Measurement of 50% Particle Diameter (D50) Based on Volume Distribution of Magnetic Carrier>

The 50% particle diameter (D50) based on volume distribution of the magnetic carrier was measured using a sample feeder for dry measurement "One-Shot Dry Type Sample Conditioner Turbotrac" (made by NIKKISO CO., LTD.). In the feed conditions of the Turbotrac, a dust collector was used as a vacuum source, the amount of air was approximately 33 L/sec, and the pressure was approximately 17 kPa. Control is automatically performed on the software. The particle diameter is determined as the 50% particle diameter (D50), which is an accumulated value based on volume. Control and analysis were performed using the attached software (version 10.3.3-202D).

The measurement conditions are as follows:

SetZero times: 10 seconds
measurement time: 10 seconds
the number of measurement: 1
refractive index of the particle: 1.81
shape of the particle: non-spherical
upper limit in measurement: 1408 μm
lower limit in measurement: 0.243 μm
measurement environment: approximately 23° C./50% RH <Method for Measuring Complex Capacitance C*(ω) by Measurement of AC Impedance>

A method for measuring complex capacitance C*(ω) of the magnetic carrier and the magnetic core will be described.

Weighing of Measurement Sample and Enclosing Thereof in Sample Holder

First, the magnetic carrier or magnetic core to be measured was enclosed in a sample holder having a cylindrical electrode (electrode area S: 491 $mm^2$) having a diameter of 25 mm. The magnetic carrier or the magnetic core was weighed such that the distance d between the enclosed electrodes was in the range of not less than 0.95 mm and not more than 1.05 mm when a load of 100 N was applied between the electrodes.

The reason that a load of 100 N is applied between the electrodes is as follows: unstableness of the contact resistance between the magnetic carrier particles or the magnetic core particles is reduced to stably measure the electrical properties within the particle. A load can be 0.1 to 0.4 $N/mm^2$. In the present test, the load pressure is 0.20 $N/mm^2$.

In order to suppress reduction in measurement accuracy caused by a leak electric field in the end of the electrode, the ratio S/d, i.e., the ratio of the electrode area S ($mm^2$) to the distance d (mm) between the electrodes can be 300 to 1000 (mm). In the present test, S/d is 468 to 517 mm.

Wiring Measurement Circuit

Figure 6:
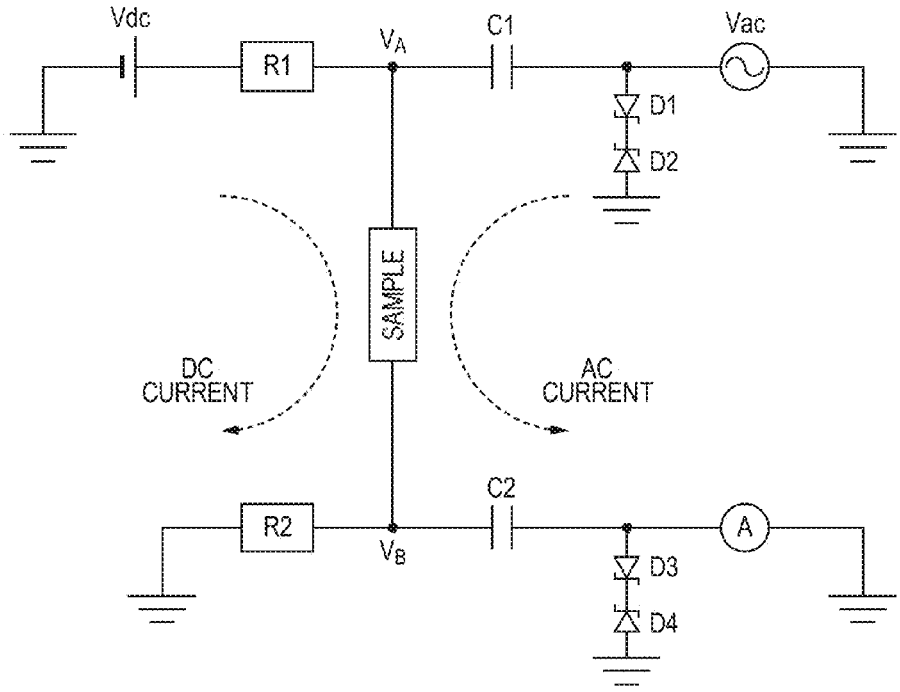
FIG. 6 is a circuit diagram illustrating a measurement circuit system used in measurement of AC impedance.

The electrodes in the sample holder were wired as illustrated in FIG. 6, and a pressure of 100 N was applied between the electrodes in the sample holder. In this state, the AC impedance of the magnetic carrier or magnetic core enclosed in the sample holder was measured.

In FIG. 6, Vac is a sinusoidal AC voltage applied to the measurement sample, and Vdc is a DC voltage output from a DC power supply. The voltage applied to the electrodes in the sample holder is V1-V2, which is a voltage waveform obtained by superimposing the DC voltage on the sinusoidal voltage. At this time, only the AC component of the response current flowing between the electrodes was extracted and analyzed. Thereby, the impedance under the DC electric field was measured. The AC impedance is measured by changing Vdc. Thereby, dependency of the complex capacitance C*(ω) on the electric field intensity can be measured. Details of a method for measuring dependency of the complex capacitance C*(ω) on electric field intensity will be described later.

As the impedance measurement apparatus, a 1260 type frequency response analyzer (FRA) made by Solartron and a 1296 type permittivity measurement interface made by Solartron were used.

The DC voltage Vdc was obtained by amplifying a DC voltage signal output from a waveform oscillator using a PZD2000 high voltage power supply made by Trek, Inc. The sinusoidal voltage Vac is output from an SAMPLE-HI terminal in the 1296 type permittivity measurement interface. In FIGS. 6, R1 and R2 each are a resistance of 10 kΩ, C1 and C2 each are a capacitor of 66 μF, and D1, D2, D3, and D4 each are a Zener diode having a breakdown voltage at 15 V.

The response current can be separated into the DC component and the AC component at the R2 and C2. At this time, only the AC component flowing on the C2 side is input to the INPUT-V1-LO terminal in the 1260 type impedance analyzer and the SAMPLE-LO terminal in the 1296 type permittivity measurement interface, the response current waveform was analyzed, and the impedance was measured.

Measurement of Complex Impedance

In the present Example, the frequency properties of the complex impedance Z* (ω) obtained by the measurement of the AC impedance were measured, and the frequency properties of the complex capacitance C*(ω) was determined according to the relationship in the expression (9) below:

$$C^*(\omega) = \frac{1}{i\omega Z^*(\omega)} \tag{9}$$

In the present Example, using impedance measurement software SMaRT made by Solartron, the complex impedance was automatically measured. The SMaRT can measure the complex impedance with respect to a predetermined frequency f by automatic analysis of the sinusoidal voltage of the predetermined frequency f and the response current. Here, the frequency f and each of frequencies ω has a relationship of ω=2πf.

In order to measure the frequency properties of the complex impedance Z*(ω), the complex impedance was measured at the frequencies below:

Frequency f:

$1.00\times10^6$ Hz, $6.31\times10^5$ Hz, $3.98\times10^5$ Hz, $2.51\times10^5$ Hz, $1.58\times10^5$ Hz, $1.00\times10^5$ Hz, $6.31\times10^4$ Hz, $3.98\times10^4$ Hz, $2.51\times10^4$ Hz, $1.58\times10^4$ Hz, $1.00\times10^4$ Hz, $6.31\times10^3$ Hz, $3.98\times10^3$ Hz, $2.51\times10^3$ Hz, $1.58\times10^3$ Hz, $1.00\times10^3$ Hz, $6.31\times10^2$ Hz, $3.98\times10^2$ Hz, $2.51\times10^2$ Hz, $1.58\times10^2$ Hz, and $1.00\times10^2$ Hz The effective value of the amplitude of the sinusoidal voltage was 1 V. From the measured frequency properties of the complex impedance Z*(ω), the complex capacitance C*(ω) can be determined based on the relationship in the expression (9).

Measurement of Dependency of Complex Capacitance C*(ω) on Electric Field Intensity In the measurement circuit system illustrated in FIG. 6, the DC component of the voltage $V_A$-$V_B$ to be applied to the measurement sample can be changed by changing the DC voltage Vdc by the DC power supply. For this reason, the electric field intensity dependency can be obtained by measuring the complex capacitance C*(ω), which can be measured by the method above, under a plurality of applied voltages.

Specifically, in order to measure the electric field intensity dependency, the AC impedance was measured at the following Vdcs ($V_1$ to $V_7$). In order to eliminate unstableness of the contact resistance between the particles, the measurement was performed in order of decreasing DC voltage value.

DC voltage Vdc:

$V_1$=300 V, $V_2$=200 V, $V_3$=120 V, $V_4$=80 V, $V_5$=50 V, $V_6$=30 V, and $V_7$=20 V During the measurement, for each of the Vdcs, the DC component of the voltage $V_A$-$V_B$ to be applied to the measurement sample is measured, and divided by the distance d between the electrodes. Thereby, an applied electric field E to be applied to the measurement sample is obtained. Accordingly, the dependency of the complex capacitance C*(ω) on the electric field intensity E is obtained.

Figure 7:
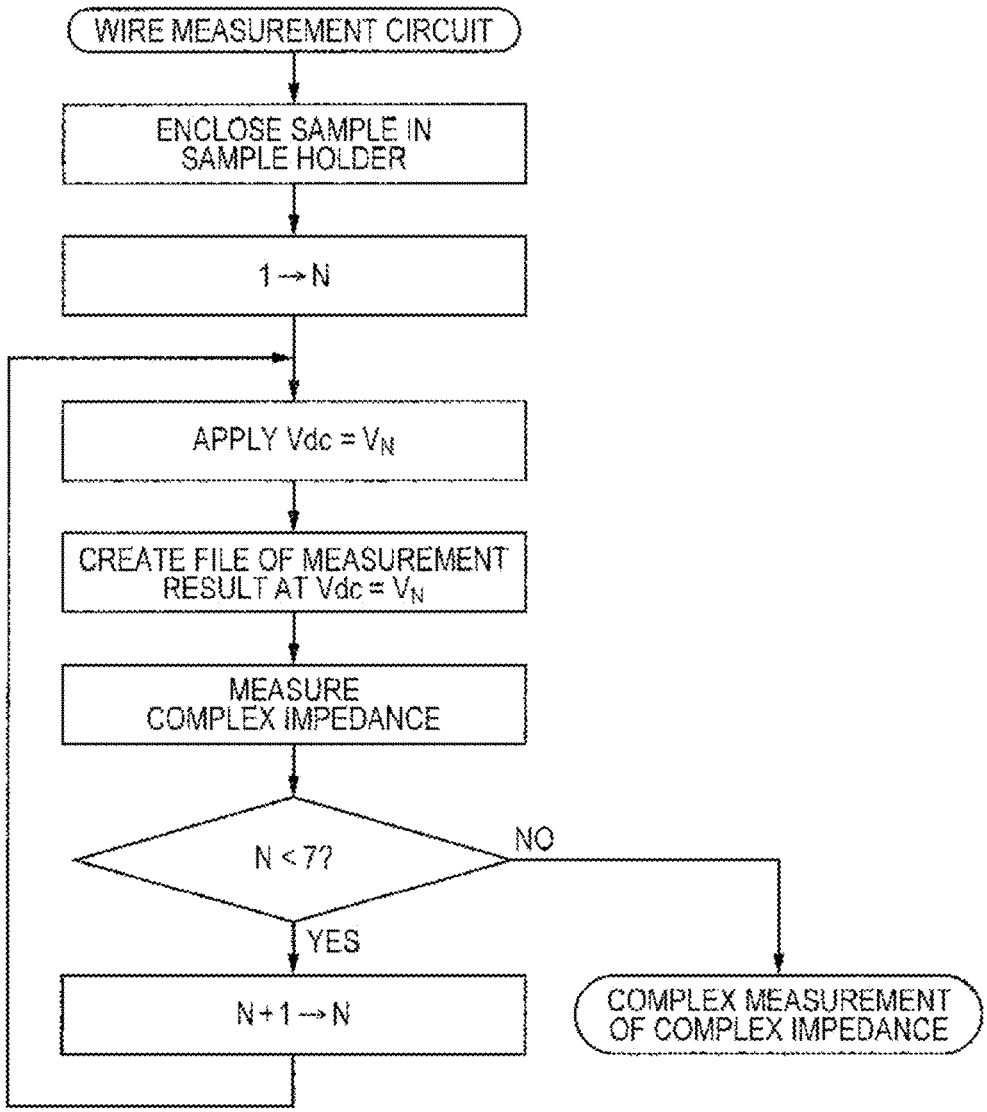
FIG. 7 is a flowchart illustrating a procedure for measuring complex impedance.

A flowchart for the measurement of the AC impedance is illustrated in FIG. 7.

<Method for Calculating $C_B$ and $C_G$ in Magnetic Core and Magnetic Carrier>

A method for calculating the capacitance $C_B$ of the grain boundary, the electric resistance $R_{GB}$ of the grain boundary, the capacitance $C_G$ of the crystal, and the electric resistance $R_G$ of the crystal in the magnetic core and the magnetic carrier using the result of measurement of the dependency of the complex capacitance C*(ω) on the frequency measured according to the measurement procedure will be described.

Calculation of Relaxation Property Parameters R, $C_\infty$, $C_S$, $\tau$, and $\alpha$ by Equivalent Circuit Fitting The results of measurement of the frequency properties of the complex capacitance $C^*(\omega)$ are fitted by the relaxation property in the expression (1), and the relaxation property parameters R, $C_\infty$, $C_S$, $\tau$, and $\alpha$ are calculated. It is known that the relaxation property to be given in the expression (1) is equivalent to the dielectric relaxation property of the complex capacitance in the equivalent circuit illustrated in FIG. 8. In the equivalent circuit, CPE represents a Constant Phase Element, and the impedance $Z_{CPE}(\omega)$ is represented by the expression (12) below. Here, T is a constant, $\alpha$ is a constant of not less than 0 and not more than 1.

$$Z_{CPE}(\omega) = \frac{1}{(i\omega)^\alpha T} \tag{10}$$

The complex impedance $Z^*(\omega)$ in the whole equivalent circuit is represented by the expression (11) below:

$$Z^*(\omega) = \left[R^{-1} + \left(\frac{1}{i\omega C_\infty}\right)^{-1} + \left(\frac{1}{i\omega(C_S - C_\infty)} + \frac{1}{(i\omega)^\alpha T}\right)^{-1}\right]^{-1} \tag{11}$$

In addition, from the relationship of the expression (9), the complex capacitance $C^*$ is represented by the expression (12) below:

$$C^*(\omega) = C_\infty + \frac{C_S - C_\infty}{1 + (i\omega)^{1-\alpha}\left(\frac{C_S - C_\infty}{T}\right)} + \frac{1}{i\omega R} \tag{12}$$

Figure 8:
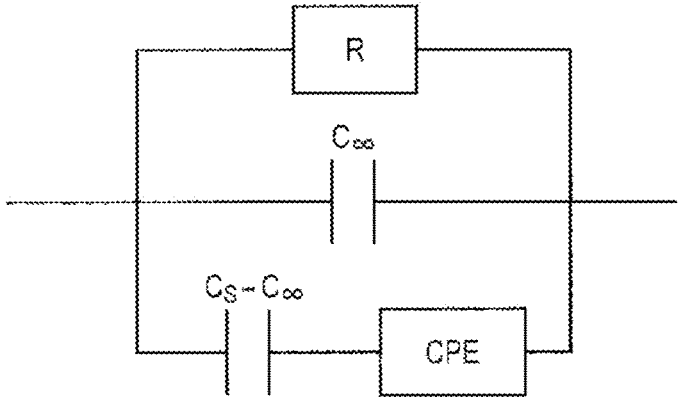
FIG. 8 is an equivalent circuit model illustrating a dielectric relaxation property of the capacitance of the magnetic carrier.

Accordingly, using the impedance parameters $C_\infty$, $C_S$, $\tau$, and $\alpha$ in the equivalent circuit in FIG. 8, $\tau$ in the expression (1) is represented by the relationship of the expression (13) below:

$$\tau = \left(\frac{C_S - C_\infty}{T}\right)^{\frac{1}{1-\alpha}} \tag{13}$$

Figure 9:
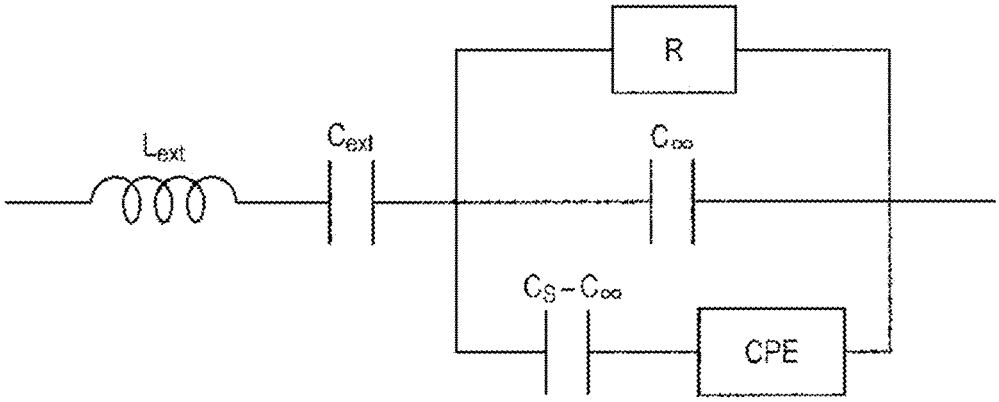
FIG. 9 is an equivalent circuit model used in parameter fitting of the complex impedance.

For this reason, in the present Example, the measured frequency properties of the complex impedance $Z^*(\omega)$ were fitted by the frequency properties of the complex impedance of the equivalent circuit illustrated in FIG. 9. Thereby, the equivalent circuit properties parameters R, $C_\infty$, $C_S$-$C_\infty$, T, and $\alpha$ were determined. Further, using the relationship of the expression (12), the relaxation property parameters R, $C_\infty$, $C_S$, $\tau$, and $\alpha$ of the complex capacitance $C^*(\omega)$ were calculated.

$L_{ext}$ and $C_{ext}$ added in FIG. 9 are inductance and capacitance, respectively, attributed to an outside of the measurement sample holder in the measurement. These were added to improve accuracy of the fitting. The cause of $L_{ext}$ and $C_{ext}$ is derived from floating inductance and floating capacitance in the circuit system and C1 and C2 in the circuit system.

In the present Example, the Equivalent Circuits function in analyzing software ZView2 made by Solartron was used. As the procedure for the equivalent circuit fitting, first, the equivalent circuit illustrated in FIG. 9 was created on the software. As the values of $L_{ext}$, $C_{ext}$, R, $C_\infty$, $C_S$-$C_\infty$, T (written as CPE-T in ZView2), and $\alpha$ (written as CPE-P in ZView2), a parameter initial value A was set as follows.

Parameter initial value A $L_{ext}$: $2.0\times10^{-5}$ Fixed $C_{ext}$: $2.0\times10^{-5}$ Fixed R: $1.0\times10^{4}$ Free (+)

C.: $1.0\times10^{-10}$ Free (+)

$C_S$-$C_\infty$: $1.0\times10^{-9}$ Free(+)

T: $1.0\times10^{-6}$ Free (+)

$\alpha$: 0.3 Free (+)

In the present Example, further, the following conditions were set as the fitting conditions in ZView2:

Data Range: All Points

Type of Fitting: Complex

Type of Data Weighting: Data-Proportional

The above conditions were set, and the measurement data on the complex impedance measured at the largest applied electric field (300 V ($V_1$) in the present Example) was selected. Fitting calculation was performed by Run Fit, and the values of R, $C_\infty$, $C_S$, T, and $\alpha$ were calculated supposing that $L_{ext}$ was $2.0\times10^{-5}$ H (henry) and $C_{ext}$ was $2.0\times10^{-5}$ F (farad). At this time, if the fitting result greatly deviated from the measured complex impedance properties, or if the calculation halted on the software, a parameter initial value different from the parameter initial value A was reset properly, and the fitting calculation was performed in the same manner again. Next, the calculated parameter was set as the fitting initial value, the initial values of $L_{ext}$ and $C_{ext}$ was changed from Fixed to Free (+), and the fitting was again performed by Run Fit. Thus, more accurate values of R, $C_\infty$, $C_S$-$C_\infty$, T, and $\alpha$ were calculated, wherein $L_{ext}$ and $C_{ext}$ were closer to the actual measurement system.

Subsequently, the value of the fitting result was newly set as the initial value, and the measurement data on the complex impedance measured at the second largest applied electric field (200 V ($V_2$) in the present Example) was selected, and the values of R, $C_\infty$, $C_S$-$C_\infty$, T, and $\alpha$ were calculated according to the same procedure.

Hereinafter, according to the same procedure, the measurement data on the complex impedances measured under a plurality of applied electric fields was selected in order of decreasing applied electric field, the previous fitting result was used as the initial value in the next fitting, and the equivalent circuit fitting calculation was performed.

From the thus-obtained values of R, $C_\infty$, $C_S$-$C_\infty$, T, and $\alpha$, using the relationship of the expression (12), the parameters R, $C_\infty$, $C_S$, $\tau$, and $\alpha$ in the relaxation property of the complex capacitance $C^*(\omega)$ represented by the expression (1) can be determined.

Figure 10:
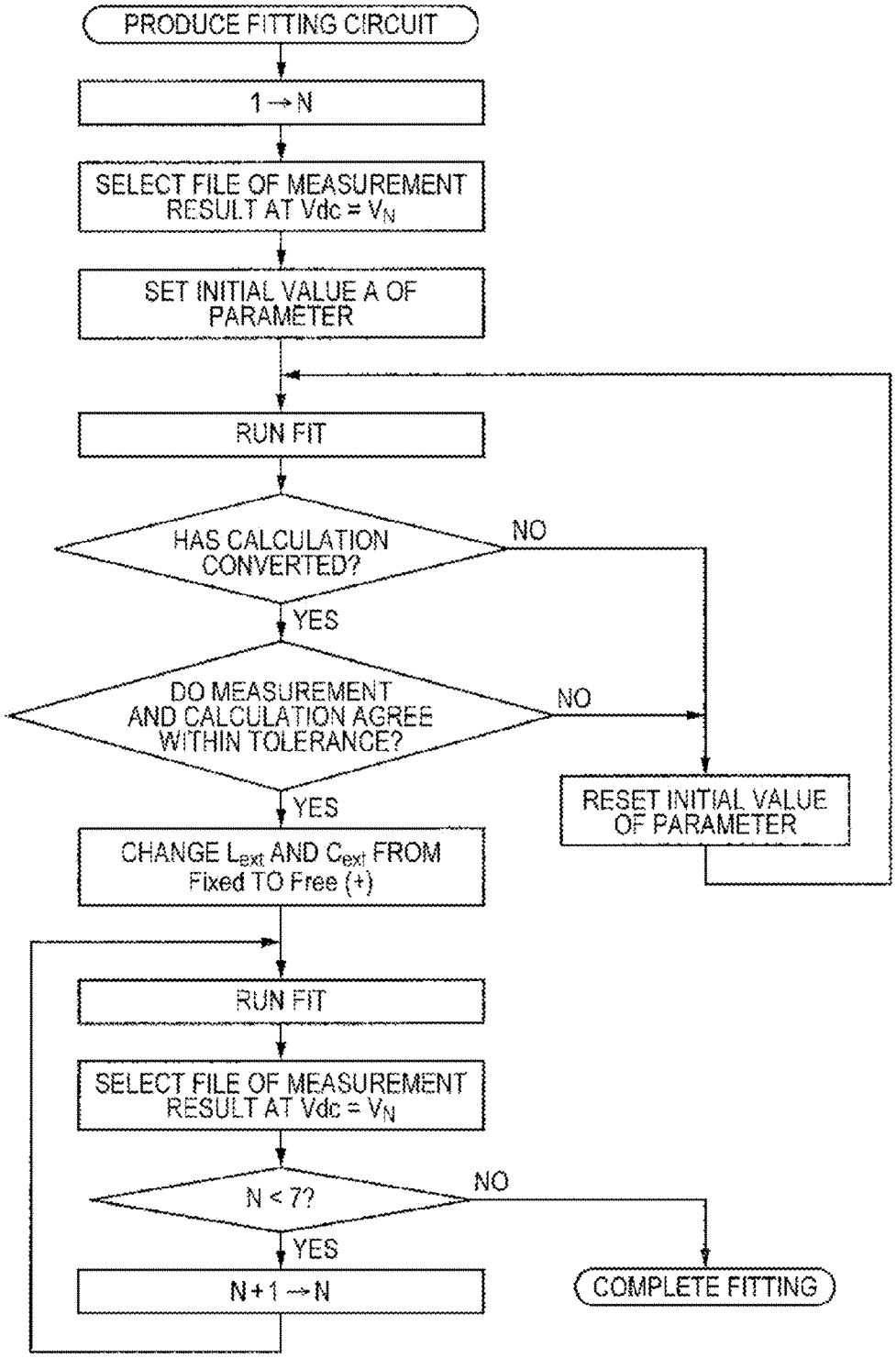
FIG. 10 is a flowchart illustrating a procedure for equivalent circuit fitting of the complex impedance.

A more specific procedure for the equivalent circuit fitting followed the flowchart illustrated in FIG. 10. In the flowchart, in "DO MEASUREMENT AND CALCULATION AGREE WITHIN TOLERANCE?," "YES" was selected when there was a small error between the calculated values and measurement results of the fitting parameters R, $C_\infty$ and $C_S$-$C_\infty$, and the values of Error % each fell within 20%, the values of Error % being displayed together with the results of calculation of R, $C_\infty$ and $C_S$-$C_\infty$.

Calculation of $C_B$ and $C_G$

In the magnetic core and the magnetic carrier, the value of the capacitance $C_B$ of the grain boundary and the value of the capacitance $C_G$ of the crystal can be calculated by the expressions (2) and (3) below using R, $C_\infty$, $C_S$, τ, and α determined by the procedure.

$$C_G = C_\infty \frac{(\xi^2 - 1)\tau}{RCs\xi - \tau} \tag{2}$$

$$C_B = C_\infty \frac{(\xi^2 - 1)\tau}{RCs\xi^{-1} - \tau} \tag{3}$$

wherein $$\begin{cases} \xi = \frac{1}{2}\left(k + m\sqrt{k^2 - 4}\right) \\ m = \frac{RCs - \tau}{|RCs - \tau|} \\ k = \frac{(RCs - \tau)^2}{R(Cs - C_\infty)\tau} + 2 \end{cases} \tag{4}$$

As above, the expression (1) is a relational expression that represents the dielectric relaxation property of the complex capacitance in the actual magnetic core and magnetic carrier. The expressions (2) and (3) are solutions for $C_G$ and $C_B$ in the simultaneous equations represented by the expression (8). From the dielectric relaxation property parameters of the complex capacitance R, $C_\infty$, $C_S$, and τ obtained by the measurement of the AC impedance and the fitting of the results of measurement, $C_G$ and $C_B$ can be calculated. In the general solution for $C_G$ and $C_B$ of the simultaneous equations represented by expression (8), m in the first expression in the expression (4) is usually ±1. In this analysis, a polycrystalline sintered body is assumed. Accordingly, the second expression in the expression (4) is given such that the relationship of $C_G \leq C_B$ is satisfied, and the sign for m was determined.

Figure 11:
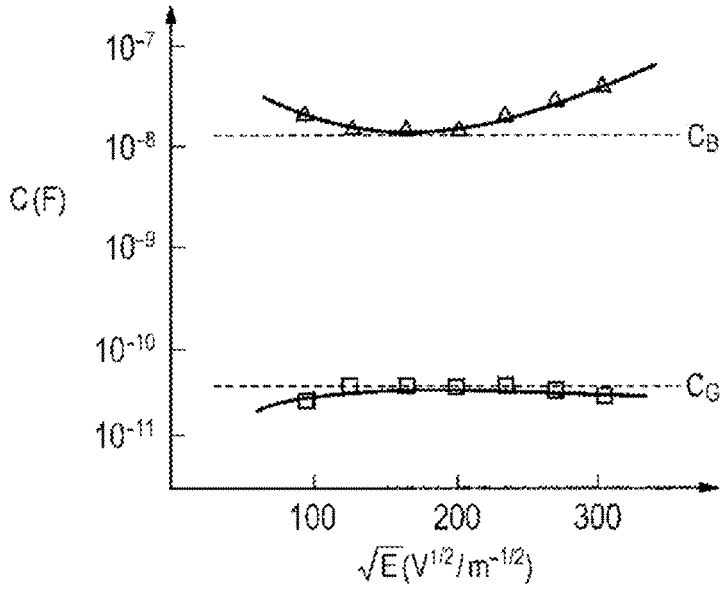
FIG. 11 is a schematic view illustrating electric field dependency of a capacitance $C_G$ of the crystal and a capacitance $C_B$ of the grain boundary.
Figure 12:
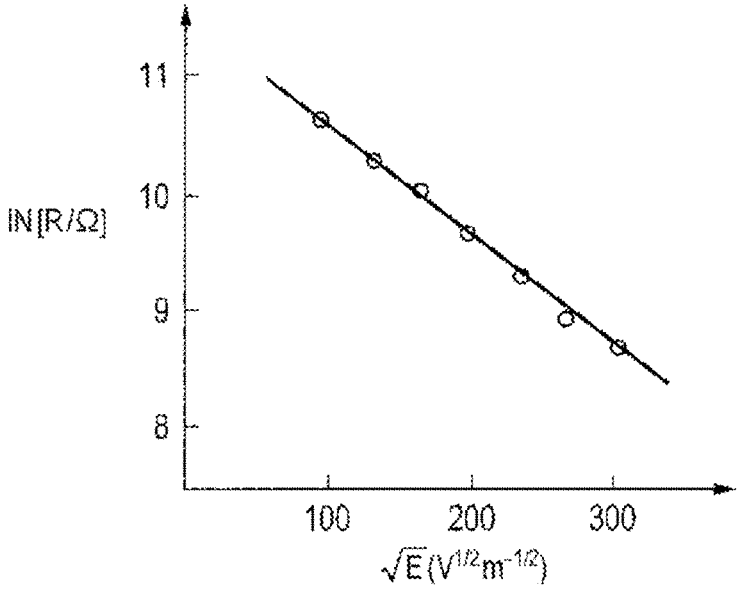
FIG. 12 is a schematic view illustrating electric field dependency of an electric resistance R of the magnetic core.

An example of a graph is illustrated in FIG. 11, in which $C_G$ and $C_B$ calculated according to the procedure is plotted against the square root of the applied electric field E (V/m). An example of a graph is illustrated in FIG. 12, in which the natural logarithm of R is plotted against the square root of the applied electric field E (V/m).

In the present test example, as the value of the ratio $C_B/C_G$ of the capacitance $C_B$ of the grain boundary to the capacitance $C_G$ of the crystal, the value when $C_B/C_G$ was the smallest with respect to the applied electric field E was used (see FIG. 11).

The value of K defined by the expression (5) below was calculated from the inclination of the line obtained by linear approximation of the plot of the graph in FIG. 12 according to the method of least squares.

$$K \equiv -\frac{d}{d\sqrt{E}}\ln(R) \tag{5}$$

EXAMPLES

Hereinafter, the present invention will be more specifically described using specific Production Examples and Examples, but the present invention will not be limited to these.

Hereinafter, Production Examples of the materials that form the magnetic carrier and the magnetic carrier used in the present invention will be shown.

<Production Example of Magnetic Core 1>

—Step 1: Production of Pulverized Product of Calcined Ferrite—

Step 1-1 (Weighing and Mixing Step):

Ferrite raw materials were weighed as follows:

| | |
|---|---|
| $Fe_2O_3$ | 63.0 parts by mass |
| $MnCO_3$ | 29.0 parts by mass |
| $Mg(OH)_2$ | 5.0 parts by mass |
| $SrCO_3$ | 2.5 parts by mass |
| CaO | 0.5 parts by mass |

Subsequently, the materials were crushed and mixed for 2 hours by a dry ball mill using a ball of zirconia (diameter of 10 mm).

Step 1-2 (Calcination Step):

After crushing and mixing, using a burner type calcinating furnace, the materials were burned in the air at 950° C. for 2 hours to produce calcined ferrite. The composition of ferrite is as shown below, in which the numeric values represent a molar ratio.

$$(MnO)_{0.333}(MgO)_{0.113}(SrO)_{0.022}(CaO)_{0.012}(Fe_2O_3)_{0.520}$$

Step 1-3 (Crushing Step):

The calcined ferrite was crushed by a crusher to have a diameter of approximately 0.3 mm, and 30 parts by mass of water was added based on 100 parts by mass of the calcined ferrite. Using a ball of stainless steel (diameter of 10 mm), the mixture was crushed for 1 hour by a wet ball mill. The slurry was crushed for 1 hour by a wet bead mill using a zirconia bead (diameter of 1.0 mm) to obtain Ferrite Slurry A (pulverized product of the calcined ferrite).

—Step 2: Production of Magnetic Core—

Step 2-1 (Granulation Step):

2.0 parts by mass of polyvinyl alcohol as a binder was added based on 100 parts by mass of Ferrite Slurry A, and the slurry was granulated into a spherical particle by a spray dryer (made by OHKAWARA KAKOHKI CO., LTD.).

Step 2-2 (Burning Step):

In order to control the burning atmosphere, using an electric furnace under nitrogen atmosphere (concentration of oxygen of 0.3% by volume), the temperature was raised over 8 hours from room temperature to 900° C., and raised over 1 hour to the burning peak temperature of 1130° C. The temperature was kept at 1130° C. as it was, and burning was performed for 4 hours. Subsequently, the temperature was cooled over 4 hours to 600° C., and cooled over 5 hours to room temperature to extract Ferrite Core A.

Step 2-3 (Selection Step):

Aggregated particles of Ferrite Core A were pulverized, and sieved by a sieve having an opening of 250 μm to remove coarse particles. Subsequently, feeble magnetic substances were removed using a magnetic sorting machine to obtain Magnetic Core 1.

<Production Example of Magnetic Core 2>

Magnetic Core 2 was obtained in the same manner as Magnetic Core 1 except that in Step 2-2 (Burning step) in Magnetic Core 1, the burning peak temperature was changed to 1080° C., and the cooling time to cool the temperature from the peak temperature to 600° C. was 3 hours.

<Production Example of Magnetic Core 3>

Magnetic Core 3 was obtained in the same manner as Magnetic Core 1 except that in Step 2-2 (Burning step) in Magnetic Core 1, the burning peak temperature was changed to 1180° C., and the temperature raising time from 900° C. to the peak temperature was 1.5 hours.

<Production Example of Magnetic Core 4>

Magnetic Core 4 was obtained in the same manner as Magnetic Core 1 except that the ferrite raw material in Production Step 1-1 of Magnetic Core 1 was changed to the formula below:

| | |
|---|---|
| $Fe_2O_3$ | 63.0 parts by mass |
| $MnCO_3$ | 29.0 parts by mass |
| $Mg(OH)_2$ | 4.0 parts by mass |
| $SrCO_3$ | 3.5 parts by mass |
| CaO | 0.5 parts by mass |

The composition of Magnetic Core 4 is as follows:

$$(MnO)_{0.337}(MgO)_{0.092}(SrO)_{0.032}(CaO)_{0.012}(Fe_2O_3)_{0.527}$$

<Production Example of Magnetic Core 5>

Magnetic Core 5 was obtained in the same manner as Magnetic Core 1 except that the ferrite raw material in Production Step 1-1 of Magnetic Core 1 was changed to the formula below:

| | |
|---|---|
| $Fe_2O_3$ | 65.0 parts by mass |
| $MnCO_3$ | 29.0 parts by mass |
| $Mg(OH)_2$ | 4.5 parts by mass |
| $SrCO_3$ | 1.0 part by mass |
| CaO | 0.5 parts by mass |

The composition of Magnetic Core 5 is as follows:

$$(MnO)_{0.335}(MgO)_{0.103}(SrO)_{0.009}(CaO)_{0.012}(Fe_2O_3)_{0.541}$$

<Production Example of Magnetic Core 6>

Magnetic Core 6 was obtained in the same manner as Magnetic Core 1 except that the ferrite raw material in Production Step 1-1 of Magnetic Core 1 was changed to the formula below:

| | |
|---|---|
| $Fe_2O_3$ | 64.0 parts by mass |
| $MnCO_3$ | 29.0 parts by mass |
| $Mg(OH)_2$ | 4.5 parts by mass |
| $SrCO_3$ | 1.0 part by mass |
| CaO | 1.5 parts by mass |

The composition of Magnetic Core 6 is as follows:

$$(MnO)_{0.330}(MgO)_{0.101}(SrO)_{0.009}(CaO)_{0.035}(Fe_2O_3)_{0.525}$$

<Production Example of Magnetic Core 7>

Magnetic Core 7 was obtained in the same manner as Magnetic Core 1 except that in Step 2-2 (Burning step) of Magnetic Core 1, the temperature was raised over 7 hours from room temperature to the burning peak temperature of 1080° C., burning was performed while the temperature was kept at 1080° C. as it was for 5 hours, and the temperature was cooled over 10 hours to room temperature.

<Production Example of Magnetic Core 8>

Magnetic Core 8 was obtained in the same manner as Magnetic Core 1 except that in Step 2-2 (Burning step) of Magnetic Core 1, the temperature was raised over 8 hours from room temperature to the burning peak temperature of 1230° C., burning was performed while the temperature was kept at 1230° C. as it was for 4 hours, and the temperature was cooled over 11 hours to room temperature.

<Production Example of Magnetic Core 9>

Magnetic Core 9 was obtained in the same manner as Magnetic Core 1 except that the ferrite raw material in Production Step 1-1 of Magnetic Core 1 was changed to the formula below:

| | |
|---|---|
| $Fe_2O_3$ | 63.0 parts by mass |
| $MnCO_3$ | 29.0 parts by mass |
| $Mg(OH)_2$ | 5.5 parts by mass |
| $SrCO_3$ | 2.5 parts by mass |

The composition of Magnetic Core 9 is as follows:

$$(MnO)_{0.333}(MgO)_{0.124}(SrO)_{0.022}(Fe_2O_3)_{0.520}$$

<Production Example of Magnetic Core 10>

Magnetic Core 10 was obtained in the same manner as Magnetic Core 1 except that the ferrite raw material in Production Step 1-1 of Magnetic Core 1 was changed to the formula below:

| | |
|---|---|
| $Fe_2O_3$ | 64.0 parts by mass |
| $MnCO_3$ | 29.0 parts by mass |
| $Mg(OH)_2$ | 5.5 parts by mass |
| CaO | 1.5 parts by mass |

The composition of Magnetic Core 10 is as follows:

$$(MnO)_{0.326}(MgO)_{0.122}(CaO)_{0.034}(Fe_2O_3)_{0.518}$$

<Production Example of Magnetic Core 11>

Magnetic Core 11 was obtained in the same manner as Magnetic Core 1 except that the ferrite raw material in Production Step 1-1 of Magnetic Core 1 was changed to the formula below:

| | |
|---|---|
| $Fe_2O_3$ | 65.0 parts by mass |
| $MnCO_3$ | 29.0 parts by mass |
| $Mg(OH)_2$ | 5.0 parts by mass |
| $SrCO_3$ | 2.5 parts by mass |
| $SiO_2$ | 0.5 parts by mass |

The composition of Magnetic Core 10 is as follows:

$$(MnO)_{0.333}(MgO)_{0.113}(SrO)_{0.022}(SiO_2)_{0.011}(Fe_2O_3)_{0.521}$$

<Preparation of Resin Solution A for Coating Magnetic Core and Filling Magnetic Core>

| | |
|---|---|
| silicone varnish (SR2440 made by Dow Corning Toray Co., Ltd., the concentration of the solid content of 20% by mass) | 100 parts by mass |
| toluene | 97 parts by mass |
| γ-aminopropyltriethoxysilane | 3 parts by mass |

These were mixed, and mixed for 1 hour using a ball mill (soda-lime ball having a diameter of 10 mm) to obtain Resin Solution A.

<Production Example of Magnetic Carrier 1>

—Step 3: Production of Magnetic Carrier—

Step 3-2 (Coating Step):

100 parts by mass of Magnetic Core 1 was placed in a planetary mixer (Nauta Mixer VN made by Hosokawa Micron Corporation), and stirred wherein as the rotation conditions of the screw-like stirring blade, revolution was 3.5 turns/min and rotation was 100 turns/min. Nitrogen was flowed at a flow rate of 0.1 $m^3$/min. The heating was performed to raise the temperature to 60° C. in order to further remove toluene to reduce pressure (approximately 0.01 MPa). ⅓ (5 parts by mass) of 15 parts by mass of Resin Solution A was added to the magnetic core, and an operation for removal of toluene and coating was performed for 20 minutes. Next, another ⅓ (5 parts by mass) of the resin solution was added, and the operation for removal of toluene and coating was performed for 20 minutes. Further, the remaining ⅓ (5 parts by mass) of the resin solution was added, and the operation for removal of toluene and coating was performed for 20 minutes (the coating resin component of 1.5 parts by mass). Subsequently, the obtained magnetic carrier was placed in a mixer having a spiral blade within a rotatable mixing container (drum mixer UD-AT made by Sugiyama Heavy Industrial Co., Ltd.). The magnetic carrier was subjected to a heat treatment under a nitrogen atmosphere at a temperature of 160° C. for 2 hours while the mixing container was rotated 10 turns per minute. The obtained magnetic carrier was classified by a sieve having an opening of 70 μm. Further, using a magnetic sorting machine, a feeble magnetic substance was removed to obtain Magnetic Carrier 1.

<Production Example of Magnetic Carrier 2>

Magnetic Carrier 2 was obtained in the same manner as Magnetic Carrier 1 except that the amount of Resin Solution A in Production Step 3-2 (Coating step) of Magnetic Carrier 1 was changed to 30 parts by mass (the coating resin component of 3.0 parts by mass).

<Production Example of Magnetic Carrier 3>

—Step 3: Production of Magnetic Carrier—

Step 3-1 (Filling Step):

100 parts by mass of Magnetic Core 2 was placed in a stirring container in a mixing stirrer (a utility stirrer NDMV made by DALTON CORPORATION). While pressure within the stirring container was reduced, nitrogen gas was introduced. While the heating was performed to the temperature of 50° C., the magnetic core was stirred by a stirring blade 100 turns per minute. Subsequently, 80 parts by mass of Resin Solution A was added in the stirring container, and mixed with Magnetic Core 2. The temperature was raised to 60° C., and heating and stirring was continued for 2 hours. The solvent was removed. The core particle of Magnetic Core 2 was filled with the silicone resin composition having a silicone resin obtained from Resin Solution A. After cooling, the obtained magnetic carrier particle was placed in a mixer having a spiral blade within a rotatable mixing container (a drum mixer UD-AT made by Sugiyama Heavy Industrial Co., Ltd.). While the mixing container was rotated 2 turns per minute and stirring was performed, the magnetic carrier particle was subjected to a heat treatment under a nitrogen atmosphere at a temperature of 160° C. for 2 hours. The obtained magnetic carrier particle was classified by a sieve having an opening of 70 μm to obtain Magnetic Carrier A which was filled with 8.0 parts by mass of resin component based on 100 parts by mass of Magnetic Core 2.

Step 3-2 (Coating Step):

Next, 100 parts by mass of Magnetic Carrier A was placed in a planetary mixer (Nauta Mixer VN made by Hosokawa Micron Corporation), and stirred wherein as the rotation conditions of the screw-like stirring blade, revolution was 3.5 turns/min and rotation was 100 turns/min. Nitrogen was flowed at a flow rate of 0.1 $m^3$/min. The heating was performed to raise the temperature to 60° C. in order to further remove toluene to reduce pressure (approximately 0.01 MPa). ⅓ (5 parts by mass) of 15 parts by mass of Resin Solution A was added to the magnetic core, and an operation for removal of toluene and coating was performed for 20 minutes. Next, another ⅓ (5 parts by mass) of the resin solution was added, and the operation for removal of toluene and coating was performed for 20 minutes. Further, the remaining ⅓ (5 parts by mass) of the resin solution was added, and the operation for removal of toluene and coating was performed for 20 minutes (the coating amount of 1.5 parts by mass). Subsequently, the obtained magnetic carrier was placed in a mixer having a spiral blade within a rotatable mixing container (drum mixer UD-AT made by Sugiyama Heavy Industrial Co., Ltd.). The magnetic carrier was subjected to a heat treatment under a nitrogen atmosphere at a temperature of 160° C. for 2 hours while the mixing container was rotated 10 turns per minute. The obtained magnetic carrier was classified by a sieve having an opening of 70 μm. Further, using a magnetic sorting machine, a feeble magnetic substance was removed to obtain Magnetic Carrier 3.

<Production Examples of Magnetic Carriers 4 to 6, 9, and 10>

Magnetic Carriers 4 to 6, 9, and 10 were obtained in the same manner as was Magnetic Carrier 1 except that the magnetic core in Production Step 3-2 (Coating step) of Magnetic Carrier 1 was replaced by Magnetic Core 3 to 5, 8, or 9.

<Production Examples of Magnetic Carriers 7, 11, and 12>

Magnetic Carriers 7, 11 and 12 were obtained in the same manner as was Magnetic Carrier 3 except that the magnetic core in Production Step 3-1 (Filling step) of Magnetic Carrier 3 was replaced by Magnetic Core 6, 10, or 11.

<Production Example of Magnetic Carrier 8>

Magnetic Carrier 8 was obtained in the same manner as Magnetic Carrier 3 except that the magnetic core in Production Step 3-1 (Filling step) of Magnetic Carrier 3 was replaced by Magnetic Core 7, and 120 parts by mass of Resin Solution A was added based on 100 parts by mass of the magnetic core (the filling resin component of 12.0 parts by mass).

Table 1 shows the magnetic core to be contained, the composition ratio of the magnetic core, the burning peak temperature, the temperature raising time, the cooling time, the amount of the filling resin, the amount of the coating resin in Magnetic Carriers 1 to 12. The composition ratio of the magnetic core shown in Table 1 focuses on the composition ratios of Sr, Ca, and Si, which are expressed by w, x, and y wherein the magnetic core is represented by the composition formula below:

$$(MnO)u(MgO)v(SrO)w(CaO)x(SiO_2)Y(Fe_2O_3)z$$

Table 2 shows the magnetic core to be contained, the composition ratio of the magnetic core (Sr, Ca, and Si), the number average area of the crystal, the pore rate, the ratio $C_B/C_G$ of the capacitance $C_B$ of the grain boundary to the capacitance $C_G$ of the crystal determined by measuring the AC impedance of the magnetic core, the change rate K of the electric resistance R(Ω) with respect to the electric field intensity E (Ω·m) defined by the expression (5), the parameter α indicating the degree of variance of the relaxation constant, and the ratio $C_B/C_G$ of the capacitance $C_B$ of the grain boundary to the capacitance $C_G$ of the crystal determined by measuring the AC impedance of the magnetic carrier in Magnetic Carriers 1 to 12.

TABLE 1

| | | Composition ratio of magnetic core $(MnO)_u(MgO)_v(SrO)_w(CaO)_x(SiO_2)_y(Fe_2O_3)_z$ | | | Burning peak | Temperature raising time (hours) | |
|---|---|---|---|---|---|---|---|
| | Magnetic core | w (Sr) | x (Ca) | y (Si) | temperature (° C.) | Room temperature to 900° C. | 900° C. to peak temperature |
| Magnetic carrier 1 | Magnetic core 1 | 0.022 | 0.012 | — | 1130 | 8 | 1 |
| Magnetic carrier 2 | Magnetic core 1 | 0.022 | 0.012 | — | 1130 | 8 | 1 |
| Magnetic carrier 3 | Magnetic core 2 | 0.022 | 0.012 | — | 1080 | 8 | 1 |
| Magnetic carrier 4 | Magnetic core 3 | 0.022 | 0.012 | — | 1180 | 8 | 1.5 |
| Magnetic carrier 5 | Magnetic core 4 | 0.032 | 0.012 | — | 1130 | 8 | 1 |
| Magnetic carrier 6 | Magnetic core 5 | 0.009 | 0.012 | — | 1130 | 8 | 1 |
| Magnetic carrier 7 | Magnetic core 6 | 0.009 | 0.035 | — | 1130 | 8 | 1 |
| Magnetic carrier 8 | Magnetic core 7 | 0.022 | 0.012 | — | 1080 | 7 | |
| Magnetic carrier 9 | Magnetic core 8 | 0.022 | 0.012 | — | 1230 | 8 | |
| Magnetic carrier 10 | Magnetic core 9 | 0.022 | — | — | 1130 | 8 | 1 |
| Magnetic carrier 11 | Magnetic core 10 | — | 0.034 | — | 1130 | 8 | 1 |
| Magnetic carrier 12 | Magnetic core 11 | 0.022 | — | 0.011 | 1130 | 8 | 1 |

| | Cooling time (hours) | | Amount of | Amount of | Volume-based 50% particle diameter of |
|---|---|---|---|---|---|
| | Room temperature to 900° C. | 900° C. to peak temperature | filling resin (parts by mass) | coating resin (parts by mass) | magnetic carrier (μm) |
| Magnetic carrier 1 | 4 | 5 | — | 1.5 | 35.6 |
| Magnetic carrier 2 | 4 | 5 | — | 3.0 | 35.9 |
| Magnetic carrier 3 | 3 | 5 | 8.0 | 1.5 | 39.5 |
| Magnetic carrier 4 | 4 | 5 | — | 1.5 | 32.1 |
| Magnetic carrier 5 | 4 | 5 | — | 1.5 | 31.8 |
| Magnetic carrier 6 | 4 | 5 | — | 1.5 | 37.8 |
| Magnetic carrier 7 | 4 | 5 | 8.0 | 1.5 | 36.3 |
| Magnetic carrier 8 | 10 | | 12.0 | 1.5 | 31.9 |
| Magnetic carrier 9 | 10 | | — | 1.5 | 29.6 |
| Magnetic carrier 10 | 4 | 5 | — | 1.5 | 33.9 |
| Magnetic carrier 11 | 4 | 5 | 8.0 | 1.5 | 35.2 |
| Magnetic carrier 12 | 4 | 5 | 8.0 | 1.5 | 37.3 |

TABLE 2

| | Magnetic core | Number average area of crystal ($\mu m^2$) | Area ratio of ferrite portion in cross section of magnetic carrier | Magnetic core $C_B/C_G$ | K | α | Magnetic carrier $C_B/C_G$ |
|---|---|---|---|---|---|---|---|
| Magnetic carrier 1 | Magnetic core 1 | 3.4 | 0.83 | 690 | 0.0135 | 0.16 | 186 |
| Magnetic carrier 2 | Magnetic core 1 | 3.4 | 0.83 | 690 | 0.0135 | 0.16 | 78 |
| Magnetic carrier 3 | Magnetic core 2 | 2.4 | 0.72 | 465 | 0.0131 | 0.26 | 123 |
| Magnetic carrier 4 | Magnetic core 3 | 5.3 | 0.88 | 322 | 0.0148 | 0.34 | 84 |
| Magnetic carrier 5 | Magnetic core 4 | 2.1 | 0.76 | 158 | 0.0083 | 0.38 | 43 |
| Magnetic carrier 6 | Magnetic core 5 | 6.1 | 0.84 | 121 | 0.0158 | 0.35 | 37 |
| Magnetic carrier 7 | Magnetic core 6 | 2.5 | 0.71 | 84 | 0.0139 | 0.42 | 25 |
| Magnetic carrier 8 | Magnetic core 7 | 3.3 | 0.58 | 38 | 0.0078 | 0.54 | 5.2 |
| Magnetic carrier 9 | Magnetic core 8 | 9.2 | 0.93 | 6.1 | 0.0201 | 0.81 | 1.8 |
| Magnetic carrier 10 | Magnetic core 9 | 7.1 | 0.89 | 17 | 0.0168 | 0.68 | 2.3 |
| Magnetic carrier 11 | Magnetic core 10 | 1.9 | 0.67 | 28 | 0.0096 | 0.45 | 3.5 |
| Magnetic carrier 12 | Magnetic core 11 | 8.1 | 0.72 | 42 | 0.0043 | 0.23 | 3.1 |

Hereinafter, Production Example of the toner used in the present invention will be described.

<Production Example of Toner>

A toner was produced using materials and a production method shown below.

polyester resin (peak molecular weight Mp of 6500, Tg of 65° C.): 100.0 parts by mass C.I. Pigment Blue 15:3: 5.0 parts by mass paraffin wax (melting point of 75° C.): 5.0 parts by mass aluminum 3,5-di-t-butylsalicylate compound: 0.5 parts by mass The materials were mixed by a Henschel mixer, and melt kneaded by a twin screw extruder. The obtained kneaded product was cooled, and coarsely crushed by a coarse crusher into not more than 1 mm to obtain a coarsely-crushed product. The obtained coarsely-crushed product was pulverized using a mill, and classified using an air classifier to obtain a cyan toner particle. The volume-based 50% particle diameter (D50) of the obtained cyan toner particle was 6.5 μm.

The following materials were externally added to 100.0 parts by mass of the obtained cyan toner particle using a Henschel mixer to produce a cyan toner. The volume-based 50% particle diameter (D50) of the obtained cyan toner was 6.6 μm.

anatase titanium oxide fine particle: 1.0 part by mass (BET specific surface area of 80 $m^2/g$, treated with 12% by mass of isobutyltrimethoxysilane)

oil processed silica: 1.0 part by mass (BET specific surface area of 95 $m^2/g$, treated with 15% by mass of silicone oil)

spherical silica: 2.5 parts by mass (BET specific surface area of 24 $m^2/g$, treated with hexamethyldisilazane)

Example 1

10 parts by mass of the cyan toner was added to 90 parts by mass of Magnetic Carrier 1, and the mixture was shaken by a V type mixer for 10 minutes to prepare a two component developer A corresponding to the initial state of development.

Using a modified machine of an imagePRESS C1 made by Canon Inc., the two component developer A was set in a developing unit for a position for black, and an image was formed under an environment of normal temperature and normal humidity (23° C., 50% RH).

A waveform signal generated using a Function Generator WF1946B made by NF CORPORATION was amplified using a high pressure power supply CAN-076 made by NF CORPORATION. The developing bias to be applied to the developing sleeve was thus obtained. The waveform of the AC component of the developing bias was set to have the so-called Duty ratio of 40:60, the Duty ratio being a ratio of a period in which the voltage value of the developing bias had a voltage value at which the electric field formed between the developing sleeve and the photosensitive member drum accelerated the toner toward the photosensitive member drum side with respect to the electric field formed by the time average developing bias Vdc to a period in which the voltage value of the developing bias had a voltage value at which the electric field formed between the developing sleeve and the photosensitive member drum accelerated the toner toward the developing sleeve side. The frequency was 6 kHz.

A transfer material used was CLC paper (made by Canon Inc., 81.4 $g/cm^2$).

Evaluation was made for (1) an image density of a solid black image portion in a recorded image output by fixing a toner image onto a transfer material, and (2) an amount of the magnetic carrier adhering onto the photosensitive member in a toner image developed in a form of a photosensitive member drum. These were evaluated according to the following methods.

Evaluation was made on the developing process conditions (a), (b), and (c) below:

(a) rotational circumferential speed (process speed) of the photosensitive member drum: 320 mm/s rotational circumferential speed of the developing Sleeve: 480 mm/s peak-to-peak voltage Vpp of the developing bias: 1.2 kV (b) rotational circumferential speed (process speed) of the photosensitive member drum: 320 mm/s rotational circumferential speed of the developing sleeve: 480 mm/s peak-to-peak voltage Vpp of the developing bias: 1.5 kV (c) rotational circumferential speed (process speed) of the photosensitive member drum: 280 mm/s rotational circumferential speed of the developing sleeve: 420 mm/s peak-to-peak voltage Vpp of the developing bias: 1.2 kV These results of evaluation are shown in Table 3.

(1) Evaluation of Image Density of Solid Black Image Portion

The image density was evaluated as follows. The charging amount of the photosensitive member drum and the amount of light exposure were adjusted to adjust the charging conditions and the exposure conditions such that the potential VL of the highest density image portion was −150 V, and the potential VD of the non-image portion was −550 V. The surface potential on the photosensitive member drum was measured using a surface electrometer (MODEL347 made by Trek, Inc.) disposed immediately under the development region in which the developing sleeve faced the photosensitive member drum.

Further, the DC component Vdc of the developing bias was set at −400 V, and the waveform of the AC component of the developing bias was a square wave of 6 kHz. The recorded image on which a solid black image was printed was output under those conditions, and the image density was evaluated using the transmission density Dt of the obtained recorded image. The value of the transmission density Dt was measured in a red filter mode by a transmission densitometer TD904 made by GretagMacbeth GmbH.

The image density was evaluated according to the following evaluation criterion:

A: the transmission density Dt is not less than 1.55 (the image density is extremely high)

B: the transmission density Dt is not less than 1.45 and less than 1.55 (the image density is an acceptable level in the present invention)

C: the transmission density Dt is less than 1.45 (the image density is low)

(2) Amount of Magnetic Carrier Adhering onto Photosensitive Members

The amount of the carrier adhering onto the photosensitive member was evaluated as follows. Under the same image output conditions as in (1) Evaluation of image density, a solid black image was developed on the photosensitive member. Immediately before the toner image developed on the photosensitive member was transferred to a primary transfer unit, the main body of the image forming apparatus (a modified machine of an imagePRESS C1 made by Canon Inc.) was turned off. The toner image developed on a solid black portion on the photosensitive member was removed by a tape. Using an optical microscope, the number of the magnetic carrier particles on the toner image of 5 $cm^2$ was counted. Then, the amount N of the adhering magnetic carrier per unit area (the number of the magnetic carriers/$cm^2$) was calculated.

The amount of the magnetic carrier adhering onto the photosensitive member was evaluated according to the following evaluation criterion:

A: the amount N of the adhering magnetic carrier is less than 1 particle/$cm^2$ (not recognized as image defects, a good level)

B: the amount N of the adhering magnetic carrier is not less than 1 particle/$cm^2$ and less than 5 particles/$cm^2$ (a small amount of carrier remains on the recorded image, an acceptable level in the present invention)

C: the amount of the adhering magnetic carrier is not less than 5 particles/$cm^2$ (the carrier remains are remarkable on the recorded image, and sufficiently recognized as image defects)

Examples 2 to 7, Comparative Examples 1 to 5

By the same method as that in Example 1, Magnetic Carriers 2 to 12 and the cyan toner were combined to prepare two component developers. In each of the two component developers, (1) the image density and (2) the amount of the magnetic carrier adhering onto the photosensitive member were evaluated. The result of evaluation is shown in Table 3.

TABLE 3

| | | (a) Process speed 320 mm/s Developing bias Vpp of 1.2 kV | | (b) Process speed 320 mm/s Developing bias Vpp of 1.5 kV | | (c) Process speed 280 mm/s Developing bias Vpp of 1.2 kV | |
|---|---|---|---|---|---|---|---|
| | | Image density Dt | Amount N of adhering magnetic carrier N ($cm^{-2}$) | Image density Dt | Amount N of adhering magnetic carrier N ($cm^{-2}$) | Image density Dt | Amount N of adhering magnetic carrier N ($cm^{-2}$) |
| Example 1 | Magnetic carrier 1 | A (1.63) | A (0.8) | A (1.69) | B (2.7) | A (1.65) | A (0.4) |
| Example 2 | Magnetic carrier 2 | B (1.48) | A (0.6) | A (1.56) | B (2.4) | B (1.52) | A (0.4) |
| Example 3 | Magnetic carrier 3 | B (1.52) | B (2.8) | A (1.58) | C (5.0) | A (1.55) | B (1.7) |
| Example 4 | Magnetic carrier 4 | A (1.55) | B (1.2) | A (1.60) | B (4.1) | A (1.58) | B (1.0) |
| Example 5 | Magnetic carrier 5 | B (1.49) | A (0.7) | A (1.55) | B (1.5) | B (1.51) | A (0.7) |
| Example 6 | Magnetic carrier 6 | B (1.50) | B (1.6) | A (1.57) | B (3.8) | B (1.53) | B (1.4) |
| Example 7 | Magnetic carrier 7 | B (1.46) | B (3.2) | B (1.53) | C (5.3) | B (1.50) | B (2.0) |
| Comparative Example 1 | Magnetic carrier 8 | C (1.42) | C (5.8) | B (1.47) | C (7.1) | B (1.45) | B (3.5) |
| Comparative Example 2 | Magnetic carrier 9 | A (1.57) | C (9.2) | A (1.61) | C (>20) | A (1.58) | B (4.2) |
| Comparative Example 3 | Magnetic carrier 10 | A (1.56) | C (6.8) | A (1.61) | C (>20) | A (1.57) | B (4.5) |
| Comparative Example 4 | Magnetic carrier 11 | C (1.38) | B (3.0) | B (1.45) | C (6.9) | C (1.40) | B (2.6) |
| Comparative Example 5 | Magnetic carrier 12 | C (1.32) | A (0.9) | C (1.39) | B (4.1) | C (1.39) | A (0.9) |

Apparently from Table 3, in the case where Magnetic Carriers 8 to 10, i.e., the magnetic carriers proposed in the related art are used to output an image, the image density and the amount of the magnetic carrier adhering onto the photosensitive member at an acceptable level are attained in the present test when process speed is less than 300 mm/s and the peak-to-peak voltage Vpp of the developing bias is 1.2 kV. When the process speed is increased to be not less than 300 mm/s, however, Vpp of the developing bias needs to be increased to 1.5 kV in order to attain a desired image density. Unfortunately, when Vpp is increased, the amount of the magnetic carrier adhering onto the photosensitive member is also increased. For this reason, a high quality recorded image having no magnetic carrier remains could not be output.

Meanwhile, in the case where Magnetic Carriers 1 to 7, i.e., the magnetic carriers according to the present invention are used to output an image, a desired image density can be ensured at a Vpp of 1.2 kV, which enables reduction in adhesion of the magnetic carrier onto the photosensitive member, even if the process speed is increased to be not less than 300 mm/s.

From the evaluations above, according to the present invention, in the image forming method using the two component developing system in which the process speed is not less than 300 mm/s and the peak-to-peak voltage of the developing bias is 1.3 kV, a sufficient image density can be ensured, the amount of the carrier adhering onto the photosensitive member can be reduced, and a recorded image having high image quality can be output.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-188115, filed Aug. 31, 2012, which is incorporated herein in its entirety.

What is claimed is:

1. An image forming method comprising:

a step of forming an electrostatic latent image on a surface of an electrostatic latent image bearing member, and a step of developing the electrostatic latent image by using a two component developer carried on a developer carrying member to form a toner image, wherein, in the development, a surface circumferential speed of the electrostatic latent image bearing member is not less than 300 mm/s, a developing bias, in which an alternating electric field is superimposed on a DC electric field, is applied to the developer carrying member, and the peak-to-peak voltage of an AC component in the developing bias is not more than 1.3 kV, the two component developer comprises a toner and a magnetic carrier, the magnetic carrier comprises a magnetic core and a resin, and the magnetic core is a ferrite containing Sr and Ca, and in a backscattered electron image of a cross section of the magnetic carrier captured by a scanning electron microscope, i) an area ratio of a ferrite portion is not less than 0.70 and not more than 0.90, and ii) a number average area of a ferrite crystal is not less than 2.0 $\mu m^2$ and not more than 7.0 $\mu m^2$.

2. The image forming method according to claim 1, wherein in the magnetic core, a ratio $C_B/C_G$ of a capacitance $C_B$ of a grain boundary to a capacitance $C_G$ of the crystal is not less than 100, using parameters R, $C_\infty$, $C_S$, $\tau$, and $\alpha$, the ratio $C_B/C_G$ being derived by expressions (2) and (3) below:

$$C^*(\omega) = C_\infty + \frac{C_S - C_\infty}{1 + (i\omega\tau)^{1-\alpha}} + \frac{1}{i\omega R} \tag{1}$$

$$C_G = C_\infty \frac{(\xi^2 - 1)\tau}{RC_S\xi - \tau} \tag{2}$$

$$C_B = C_\infty \frac{(\xi^2 - 1)\tau}{RC_S\xi^{-1} - \tau} \tag{3}$$

the parameters R, $C_\infty$, $C_S$, $\tau$, and $\alpha$ being calculated by fitting frequency properties of a complex capacitance C* of the magnetic core obtained by measurement of an AC impedance of the magnetic core by an expression (1) above;

wherein $$\begin{cases} \xi = \frac{1}{2}\left(k + m\sqrt{k^2 - 4}\right) \\ m = \frac{RC_S - \tau}{|RC_S - \tau|} \\ k = \frac{(RC_S - \tau)^2}{R(C_S - C_\infty)\tau} + 2 \end{cases} \tag{4}$$

(wherein $\omega$ is an angular frequency, $C_\infty$ is a convergence value of the capacitance when $\omega$ is brought close to infinity, $C_S$ is a convergence value of the capacitance when $\omega$ is brought close to zero, and $C_\infty \leq C_S$; $\tau$ is a relaxation time of dielectric relaxation, and R is a DC resistance value; $\alpha$ is a real number of not less than 0 and not more than 1, and a parameter indicating a degree of variation in the relaxation time of dielectric relaxation).

3. The image forming method according to claim 2, wherein in the magnetic core, a change rate K of the parameter R ($\Omega$) with respect to an applied electric field intensity E ($\Omega \cdot m$) is not less than 0.010 and not more than 0.015, the change rate K being defined by an expression (5) below:

$$K = -\frac{d}{d\sqrt{E}}\ln(R). \tag{5}$$

4. The image forming method according to claim 2, wherein in the magnetic core, the $\alpha$ is not more than 0.30.

5. The image forming method according to claim 2, wherein in the magnetic carrier, a ratio $C_B/C_G$ of a capacitance $C_B$ of a grain boundary to a capacitance $C_G$ of a crystal is not less than 20, using parameters R, $C_\infty$, $C_S$, $\tau$, and $\alpha$, the ratio $C_B/C_G$ being derived from the expressions (2) and (3), the parameters being calculated by fitting frequency properties of a complex capacitance C* of the magnetic carrier obtained by measurement of an AC impedance of the magnetic carrier by the expression (1).

* * * * *